US007839363B2

(12) United States Patent
Kawabe

(10) Patent No.: US 7,839,363 B2
(45) Date of Patent: Nov. 23, 2010

(54) ACTIVE MATRIX DISPLAY DEVICE

(75) Inventor: Kazuyoshi Kawabe, Yokohama (JP)

(73) Assignee: Global OLED Technology LLC, Wilmington, DE (US)

( * ) Notice: Subject to any disclaimer, the term of this patent is extended or adjusted under 35 U.S.C. 154(b) by 754 days.

(21) Appl. No.: 11/570,430

(22) PCT Filed: Jun. 15, 2005

(86) PCT No.: PCT/US2005/021072

§ 371 (c)(1),
(2), (4) Date: Dec. 12, 2006

(87) PCT Pub. No.: WO2006/011998

PCT Pub. Date: Feb. 2, 2006

(65) Prior Publication Data

US 2007/0216315 A1 Sep. 20, 2007

(30) Foreign Application Priority Data

Jun. 30, 2004 (JP) ..... 2004-195030

(51) Int. Cl.
*G09G 3/30* (2006.01)
*G09G 3/10* (2006.01)

(52) U.S. Cl. ..... 345/76; 315/169.3

(58) Field of Classification Search ..... 345/76; 315/169.3

See application file for complete search history.

(56) References Cited

U.S. PATENT DOCUMENTS

| | | | | |
|---|---|---|---|---|
| 6,229,506 | B1 | 5/2001 | Dawson et al. | |
| 2004/0041765 | A1 * | 3/2004 | Koyama et al. | 345/87 |
| 2005/0156829 | A1 * | 7/2005 | Choi et al. | 345/76 |

FOREIGN PATENT DOCUMENTS

| | | |
|---|---|---|
| JP | 2004-118183 | 4/2004 |
| WO | 03/077229 | 9/2003 |

OTHER PUBLICATIONS

Choi et al, An Improved Voltage Programmed Pixel Structure for Large Size High Resolution AM-OLED Displays, SID 04 Digest, May 2004, pp. 260-263.

* cited by examiner

*Primary Examiner*—Amr Awad
*Assistant Examiner*—Jonathan Boyd
(74) *Attorney, Agent, or Firm*—Morgan Lewis & Bockius LLP

(57) ABSTRACT

To reduce variation in characteristics of a voltage-current conversion circuit for supplying a data signal to a data line for driving a transistor arranged in a pixel of an organic EL display device. Two sets A, B of voltage-current conversion circuits are provided in a data driver for driving a transistor arranged in a pixel, and RGB signals are supplied to these circuits. The voltage-current conversion circuits of sets A and B are controlled so as to be switched for every frame or every frame and line.

3 Claims, 18 Drawing Sheets

ACTIVE MATRIX DISPLAY DEVICE

FIELD OF THE INVENTION

The present invention relates to an active matrix display device, and in particular to a display device comprising a self-emissive electroluminescence element (an organic EL element) as a display element.

BACKGROUND OF THE INVENTION

Along with the recent development of an information society, a demand has arisen for portable information terminals with processing capability compatible with that of former personal computers. Accordingly, video display devices adapted to higher quality and resolution have been demanded, and thin and light video display devices having a wider viewing angle and low power consumption have been desired. In order to satisfy this demand, efforts have been made to develop methods of manufacturing display devices (displays) comprising thin film active elements arranged in a matrix on a glass substrate (a thin film transistor, a Thin Film Transistor, or simply, TFT).

Most substrates of such display devices wherein an active electrode is formed are fabricated by first forming and patterning a semiconductor film including one or more of amorphous or poly-silicon or the like and then forming metal wire connections thereon. Due to differences in electric characteristics of the active elements, an amorphous silicon display device is characterized in that it requires a driving IC (Integrated Circuit), and a polysilicon display device is characterized in that its driving circuit is formed on a substrate.

Among currently widely used liquid crystal displays (Liquid Crystal Display or simply LCD), amorphous silicon type LCDs are dominant in large liquid crystal displays, while, for medium or small popular liquid crystal displays, polysilicon types, which are suitable for high resolution, are becoming mainstream. As for thin and light self-emissive electroluminescence (organic EL) displays having a wider viewing angle, only the polysilicon type is mass-produced.

Generally, organic EL elements are used in combination with a TFT so that a current flowing thereto can be controlled by utilizing the current voltage control effect of the TFT. "Current voltage control effect" refers to an operation of controlling a current flowing between the source and drain of a TFT, by applying a voltage to the gate terminal of the TFT. With this operation, light emission intensity can be adjusted so that desired gradation can be attained.

However, inclusion of such a TFT-combined structure causes the light emission intensity of the organic EL element to be highly vulnerable to the TFT characteristics. In particular, a relatively large difference is noticed in electric characteristics of the neighboring pixels in the case of a polysilicon TFT, in particular, those which use low temperature polysilicon formed in low temperature processing. The difference is regarded as one factor which deteriorates the display quality, particularly, screen display uniformity, of an organic EL display.

U.S. Pat. No. 6,229,506 discloses a conventional technique for dealing with this problem. Specifically, this document discloses a means for controlling such that the TFT 260, which is originally designed to apply a current drive to an organic EL element 290, flows a gradation current to a data line 220, as shown in FIG. 12.

With this conventional means shown in FIG. 12, a gradation current flowing to the data line 220 is made, through a predetermined procedure, to flow into the driver TFT 260, so that a voltage which is necessary to cause the driver TFT 260 to flow a gradation current into the data line 220 is generated, and a corresponding charge is stored in a holding capacitor 280 (current writing). As the driver TFT 260 continues flowing the gradation current to the organic EL element 290 until next access is attempted, a desired gradation can be attained.

Here, a gradation current to be flowed to the data line 220 is supplied to the data line by a data driver which has a voltage current circuit for receiving RBG video signals and giving voltage-current conversion thereto. When a TFT in the voltage-current conversion circuit is formed in low temperature polysilicon processing, it is difficult to obtain uniform voltage-current conversion characteristics, and non-uniform characteristics cause a problem of deteriorated image quality.

SUMMARY OF THE INVENTION

The object of the present invention is to provide a display device capable of suppressing variation in characteristics of a voltage-current conversion circuit for supplying a data signal to a data line.

This object is achieved in an active matrix display device, comprising a plurality of voltage-current conversion circuits for performing voltage-current conversion on an input video signal to supply a resultant current as a data signal to each pixel of a display array; and an output switching circuit for switching output from the plurality of voltage-current conversion circuits with timing being adjusted at least either for each frame or for each line.

The present invention has three modes for switching, including frame switching, line switching, and frame and line switching. Also, it is preferable in the present invention to provide two or more sets for at least any of RGB signals.

In one aspect, two sets of voltage-current conversion circuits are provided to each of the RGB signals. When first and second sets of a plurality of voltage-current conversion circuits are provided, it is preferable that, in an odd frame, an odd-numbered data line is driven using the first set and an even-numbered data line is driven using the second set, while, in an even frame, the odd-numbered data line is driven using the second set and the odd-numbered data line is driven using the first set. Naturally, three or more sets of voltage-current conversion circuits may be provided.

In the present invention, two or more line sets may be provided for a video signal to be input to the voltage-current conversion circuit, so that these video signals may be switched for every data line or at least every frame or line. A variety of characteristics can be realized by combining a plurality of video signal line sets and voltage-current conversion circuit sets.

According to the present invention, two or more sets of voltage-current conversion circuits for supplying a data signal to a data line are provided, and these voltage-current conversion circuit sets are switched in providing a data signal. This can reduce variation in characteristics of the voltage-current conversion circuits.

BRIEF DESCRIPTION OF THE DRAWINGS

Preferred embodiments of the present invention will be described in detail based on the following figures, wherein.

DESCRIPTION OF THE PREFERRED EMBODIMENTS

In the following, preferred embodiments of the present invention will be described in detail with reference to the accompanying drawings.

First Embodiment

Overall Structure

Figure 1:
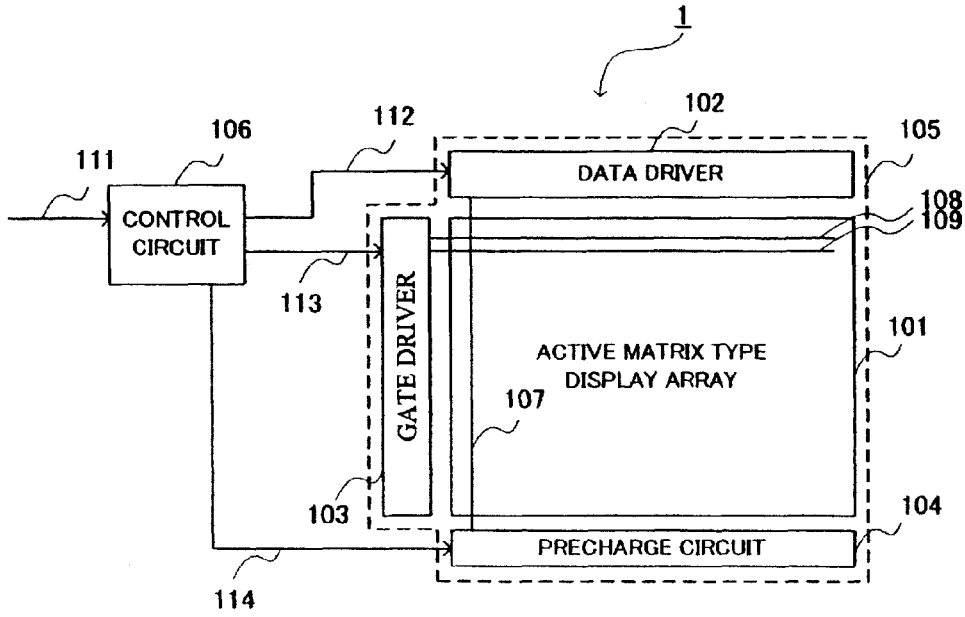
FIG. 1 is a diagram showing the complete structure of a first embodiment of the present invention.

FIG. 1 shows the overall structure of an organic EL display in this embodiment. Specifically, the organic EL display 1 comprises an active matrix display array 101, where pixels, each having an organic EL element and a TFT, are arranged, a data driver 102, a gate driver 103, a pre-charge circuit 104, a control circuit 106 for supplying a video signal and a control signal to the data driver 102 via a data control bus 112 and also a control signal to the gate driver 103 via a control bus 113, a data line 107 for supplying a gradation data current from the data driver 102 or a pre-charge voltage from the pre-charge circuit 104 to the pixel, a gate line 108 for supplying a gate selection potential from the gate driver 103, a lighting line 109 for supplying a control voltage from the gate driver 103 to control lighting of the organic EL element, and an input bus 111 for inputting RGB video data, a clock, or the like. The display array 101, the data driver 102, the gate driver 103, and the pre-charge circuit 104 together constitute a display device. These can be formed on a glass substrate through low temperature polysilicon processing.

Pixel Circuit Structure

Figure 2:
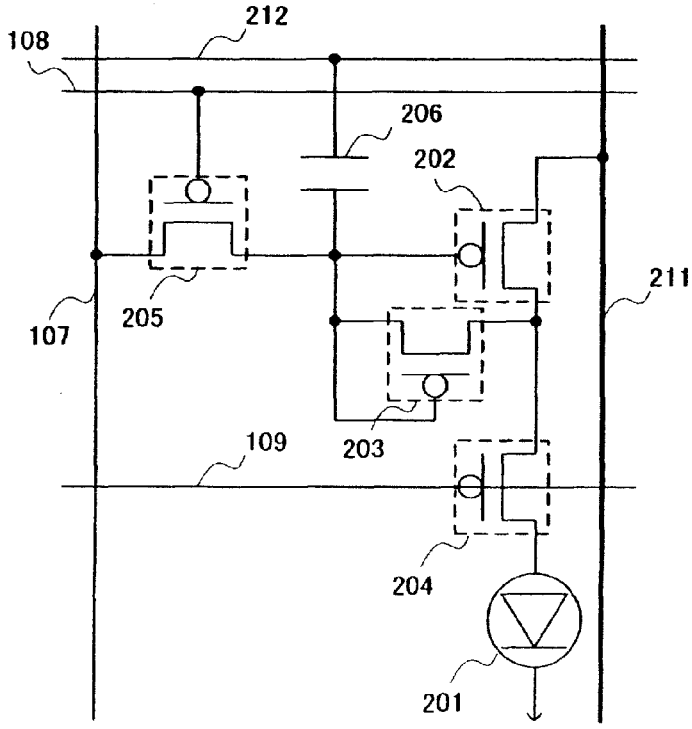
FIG. 2 is a TFT pixel circuit in the first embodiment.

With reference to FIG. 2, a structure of a pixel circuit of this embodiment is described. Pixel circuits are arranged in a matrix in the active matrix display array 101.

A pixel circuit comprises an organic EL element 201, a driver TFT 202 for applying current drive to the organic EL element 201, a diode TFT 203 for connecting the gate and drain terminals of the driver TFT 202, a lighting control TFT 204 for controlling whether or not to light the organic EL element 201 (that is, whether or not to cause a current to flow), a gate TFT 205 for controlling supply of a gradation current from a data line 107 to inside the pixel, a holding capacitor 206, a current supply line 211 for supplying a current to the organic EL element 201, and a fixed potential line 212 for fixing the potential at one terminal of the holding capacitor 206 at a predetermined value. The fixed potential line 212 may be connected to the current supply line 211.

The source terminal of the driver TFT 202 is connected to the current supply line 211; the drain terminal thereof is connected to the source terminal of the lighting control TFT 204 and to the source terminal of the diode TFT 203; and the gate terminal thereof is connected to the terminal of the holding capacitor 206 other than the one which is connected to the fixed potential line 212, as well as to the source terminal of the gate TFT 205 and the drain terminal of the diode TFT 203.

The gate terminal of the lighting control TFT 204 is connected to the lighting line 109 and the drain terminal thereof is connected to the anode of the organic EL element 201. The gate terminal of the gate TFT 205 is connected to the gate line 108, and the drain terminal thereof is connected to the data line 107. The current supply line 211, the fixed potential line 212, and the cathode electrode of the organic EL element 201 are commonly used by all pixels.

In the following, a method for driving an organic EL element using the pixel as shown in FIG. 2 is described. A method for controlling the pixel circuit shown in FIG. 2 using the data driver 102, the gate driver 103, and the pre-charge circuit 104 will be described later.

Driving Method

A. Pre-Charge

Initially, the gate TFT 205 is turned on to write a pre-charge potential into the holding capacitor 206, in which the pre-charge potential is at a level at which the organic EL element 201 stops lighting, that is, no current is supplied thereto. Therefore, the current flowing to the organic EL element 201 gradually diminishes until no current further flows into the organic EL element 201.

Control is made such that the pixel circuit of FIG. 2 is set at this initial state immediately before all gradation current writings. At this state, the organic EL element 201 remains unlit, and the gate potential of the driver TFT 202 and the potential of the data line 107 are set at a pre-charge potential.

B. Driving

Subsequently, the lighting control TFT 204 is turned off to set the drain terminal of the driver TFT 202 at a high-impedance state. Then, when the gate TFT 205 is turned on and a gradation current is flowed to the data line 107, the gradation current flows from the current supply line 211 to the data line 107 via the source and drain terminals of the driver TFT 202, the diode TFT 203 in the forward direction, and the gate TFT 205. Consequently, a gate potential which is necessary to cause the driver TFT 202 to flow the gradation current having flowed to the data line 107 is generated at the gate terminal of the driver TFT 202.

After the potential is stabilized, the lighting control TFT 204 is turned on. Thereupon, a reverse bias is applied to the diode TFT 203, and the gradation current flowing from the data line 107 stops flowing through the driver TFT 202. Thereafter, when the gate TFT 205 is turned off, a potential necessary to cause the driver TFT 202 to cause the gradation current having been flowed to the data line 107 is written into the holding capacitor 206 and held therein until next access is attempted.

Here, the cause for application of the reverse bias to the diode TFT 203 is described. As a driver TFT 202 is generally used in a saturation region, when the lighting control TFT 204 is turned on, that is, when the lighting control TFT 204 is set connected to the organic EL element 201, the drain-source voltage Vds of the driver TFT 202 becomes sufficiently large compared to the gate-source voltage Vgs, and the relationship |Vds|>|Vgs| is maintained. As a result, a reverse bias is applied to the diode TFT 203, and the current path leading to the data line 107 is thereby disconnected. Thereafter, the pixel circuit as shown in FIG. 2 is set in the initial state, and the above-described gradation current writing is repeated.

Data Driver and Pre-Charge Circuit

In the following, internal structures of the data driver 102 and pre-charge circuit 104 will be described. The data driver 102 and pre-charge circuit 104 are used to drive the display array 101 which has pixel circuits, each shown in FIG. 2, arranged in a matrix.

Figure 3:
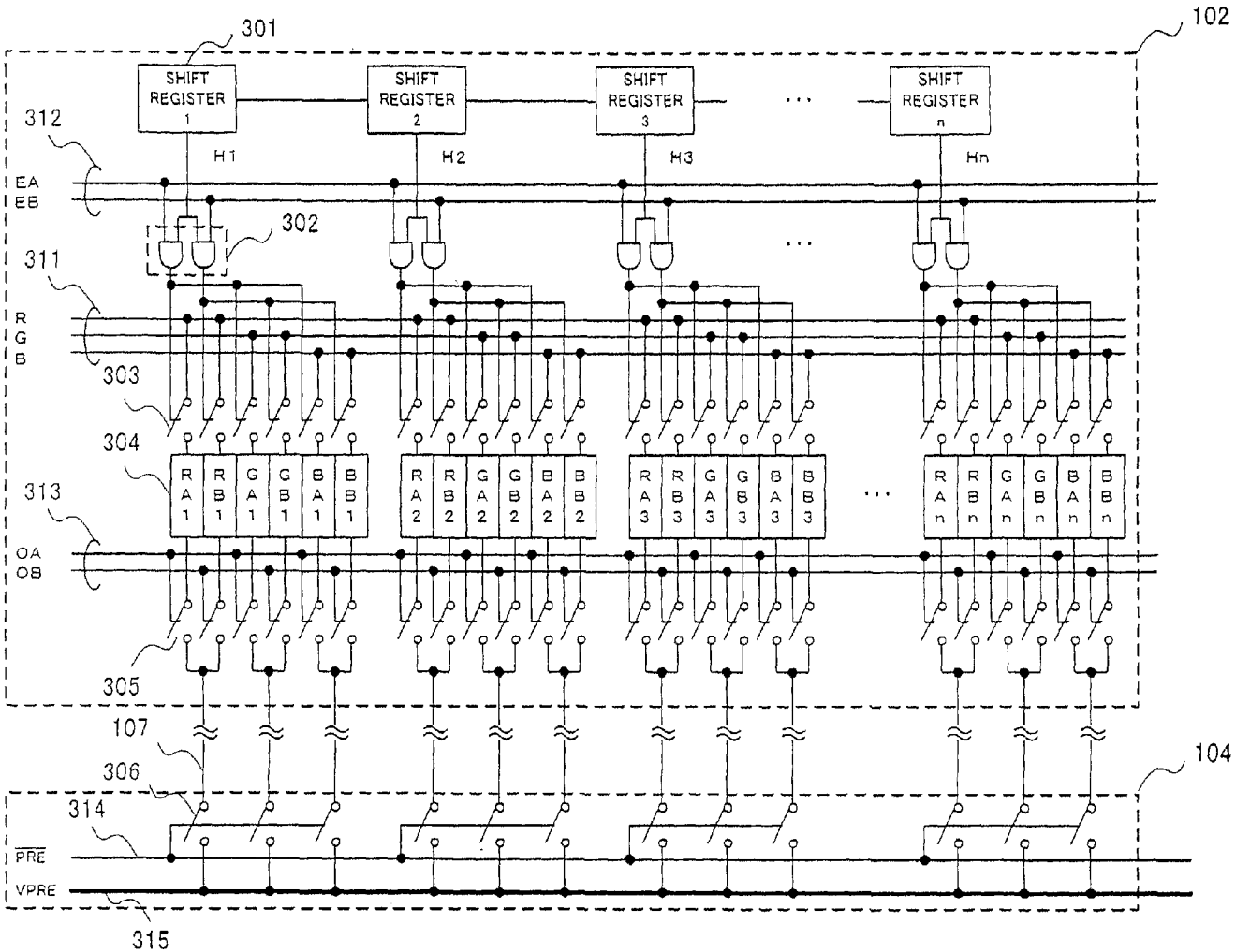
FIG. 3 is a diagram showing an internal structure of a data driver and a pre-charge circuit of the first embodiment.

The data driver 102 comprises a shift register 301, an enable circuit 302, a video switch 303, a voltage-current conversion circuit 304, a data switch 305, RGB video signal lines 311, driver select lines 312 (EA, EB), and output enable lines 313 (OA, OB). The pre-charge circuit 104 comprises a pre-charge switch 306, a pre-charge enable line 314 (PRE), and a pre-charge potential supply line 315. FIG. 3 shows the structure of a data driver and a pre-charge circuit, which has one line set of each of RGB lines.

The shift register 301 causes an input pulse to be sequentially shifted from a shift register 1 to n in synchronism with a clock. The pulses resultant from the input pulse having been shifted to the respective shift registers are output from the relevant output terminals Hi (i=1 to n), and input to the relevant pulse enable circuits 302.

In response to a signal from the driver select line 312 EA or EB, the pulse enable circuit 302 enables an output from the relevant shift register.

It should be noted that, in this example, two separate sets A and B, each including the video switch 303, the voltage-current conversion circuits 304, and the data switches 305, are provided for each of the RGB colors.

Then, in response to a pulse from the shift register, having been enabled by the pulse enable circuit 302 in response to a signal from the driver select signal line EA or EB, the video switch 303 of either set A or B is turned on to thereby connect the video signal lines 311 to the voltage-current conversion circuit 304 of the relevant set A or B. For example, when an output H1 from the shift register 1 is at "High", and the line EA is at "High", while the line EB is at "Low". The pulse enable circuit 302 associated with the shift register 1 forwards a shift pulse from the shift register 1 to the video switches 303 of the set A, which, in turn, connect the video signal lines RGB to the inputs of the subsequent voltage-current conversion circuits 304 RA1, GA1, and BA1 of set A, so that the voltage-current conversion circuits 304 RA1, GA1, and BA1 incorporate the video data.

After a shift pulse is shifted to the last shift register n and data for a horizontal line is sampled by the voltage-current conversion circuits 304 of either set A or B, as described above, the output enable line OA/OB of the set which conducted the sampling is activated. With the above, an output from the activated voltage-current conversion circuit 304 is connected to the data line 107, to thereby drive data line 107. That is, in the above example, in which the line EA is at "High", when the output enable line OA is activated after a shift pulse has been shifted to the shift register n, the data line 107 is driven by the voltage-current conversion circuit 304 of set A.

The following description will focus on the video signal lines 311. As these lines 311 are connected to the voltage-current conversion circuits 304 by means of the video switches 303, a wiring load of the video signal line 311 is equal to an input impedance of the connected voltage-current conversion circuit 304, which is relatively very small. This means that high speed transfer of a signal from the video signal line 311 to the voltage-current conversion circuit 304 is achievable. This is suitable for driving a high resolution panel.

Figure 15:
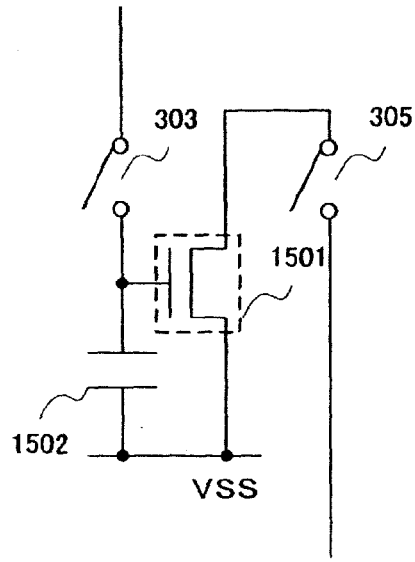
FIG. 15 is a diagram showing an internal structure of a voltage-current conversion circuit in the first embodiment.
Figure 15:
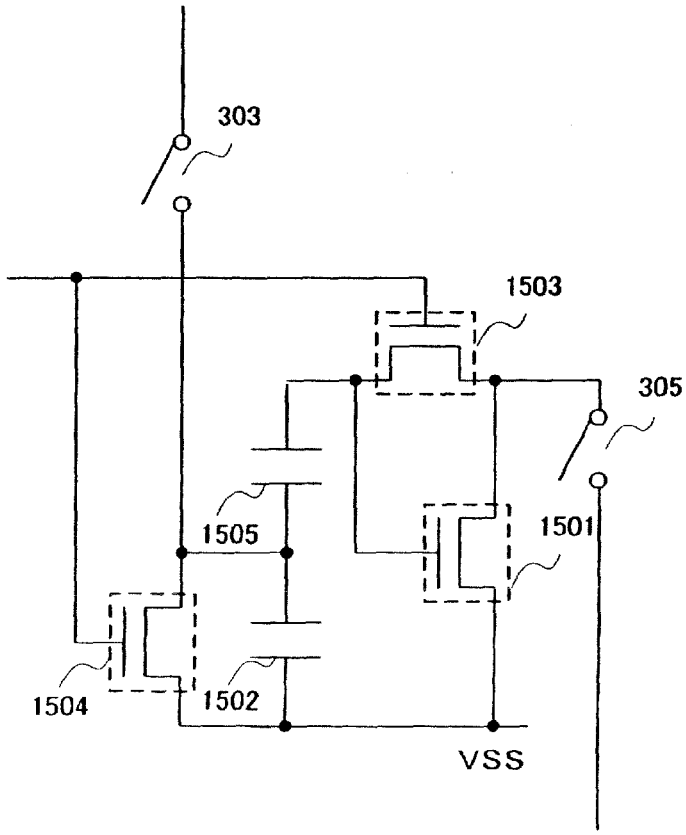

When the driver TFT 202 is formed using a P-channel TFT, as shown in FIG. 2, it is desirable that the voltage-current conversion circuit 304 is formed using an N-channel TFT, as shown in FIG. 15, for example. The simplest example of the voltage-current conversion circuit 304 is shown in FIG. 15(*a*), which comprises an N-channel voltage-current conversion TFT 1501 and a holding capacitor 1502.

Referring again to FIG. 3, in response to a shift pulse from the shift register 301 and via the video switch 303, which is subjected to control of the driver select lines EA and EB, the voltage-current conversion TFT 1501 sequentially samples data from the data bus 311 and determines a current value according to the level of the sampled voltage. After having sampled the data for one line, the TFT 1501 is connected to the data line 107 by the data switch 305, which is subjected to control by a signal from the output enable lines OA and OB, whereby the data line 107 is driven using a gradation current corresponding to the gradation voltage held in the holding capacitor 1502.

When the voltage-current conversion circuit 1501 is fabricated using low temperature polysilicon TFT processing, for example, it is difficult for the circuit to acquire uniform voltage-current conversion characteristics. In view of this problem, reset TFTs 1503, 1504 are additionally provided, as shown in FIG. 15(*b*), to correct the threshold voltage Vth of the voltage-current conversion TFT 1501 to improve uniformity in the voltage-current conversion characteristics.

Correction of Threshold Voltage Vth

A procedure to correct a threshold voltage Vth of the voltage-current conversion TFT 1501, using the reset TFTs 1503 and 1504 and the reset capacitor 1505, will be described.

Before a pulse is input to the shift register, that is, when the video switch 303 and data switch 305 are turned off and the reset TFTs 1503 and 1504 are turned on, the current flowing to the TFT 1501 gradually diminishes, becoming closer to zero. That is, the threshold voltage Vth of the reset capacitor 1505 is written into the reset capacitor 1505.

Thereafter, when the reset TFTs 1503 and 1504 are turned off, an input pulse is input to the shift register, and gradation voltage data in the data bus 311 is incorporated into the holding capacitor 1502, the gate potential Vgs of the voltage-current conversion TFT 1501 is set at "Vgs=Vth+Vd", wherein Vd represents a gradation voltage.

As described above, addition of a correction circuit to the current conversion circuit 304 can suppress variation in voltage-current conversion. In order to improve uniformity in conversion characteristic, it is desirable that the voltage-current conversion TFT 1501 is designed larger as compared to the reset TFTs 1503 and 1504.

Meanwhile, the pre-charge circuit 104, which includes a pre-charge switch 306, activates the pre-charge enable line PRE 314 to thereby connect the data line 107 to the pre-charge potential supply line 315 to pre-charge the data line 107 to a predetermined pre-charge potential VPRE.

Because the data line 107 is driven by the data driver 102 and the pre-charge circuit 104, the threshold voltage Vth of the voltage-current conversion circuit may be reset while the data line 107 is being pre-charged.

The data driver 102 may be replaced with a data driver IC which has the above-described function or a function pursuant to that function.

Gate Driver

Figure 4:
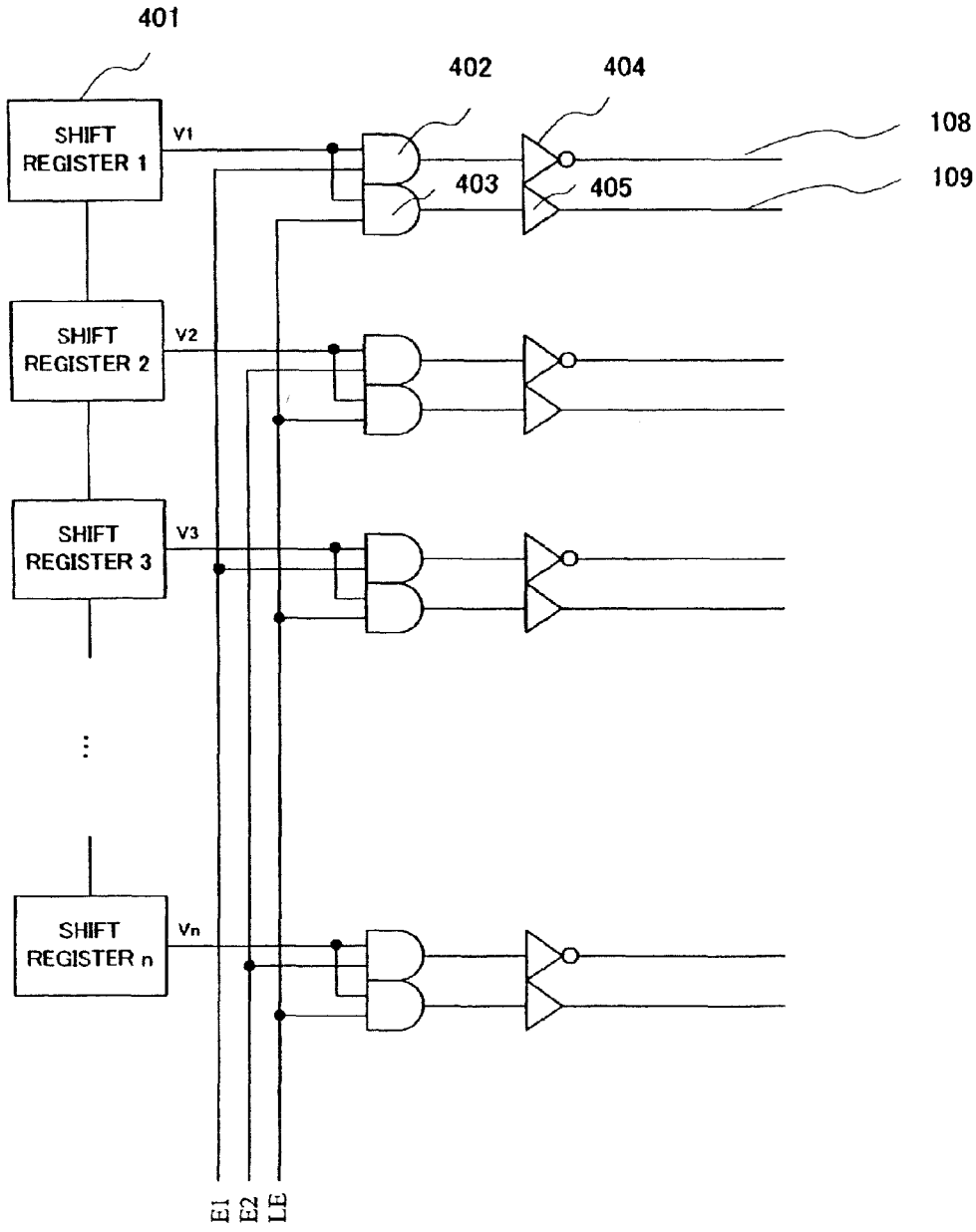
FIG. 4 is a diagram showing an internal structure of a gate driver.

Next, an internal structure of the gate driver 103 is described with reference to FIG. 4. The gate driver 103 comprises a shift register 401, a gate enable circuit 402, a lighting enable circuit 403, a gate buffer 404, and a lighting buffer 405. In the drawing, lines E1 and E2 are odd-numbered and even-numbered gate enable control lines, respectively, and a line LE is a lighting enable control line.

One input of the gate enable circuit 402 of an odd line is connected to the gate enable control line E1, while one input of the gate enable circuit 402 of an even line is connected to the gate enable control line E2. One of the inputs of the lighting enable circuits 403 of all lines is connected to the lighting enable control line LE.

The other inputs of the enable circuits 402 and 403 of the respective lines are connected to the outputs Vi (i=0 to n) of the respective shift registers. Using signals from the outputs Vi of the shift registers and the lines E1, E2, and LE, the state of the gate lines 108 and the lighting lines 109 is controlled.

Display State in Frame Period

Figure 5:
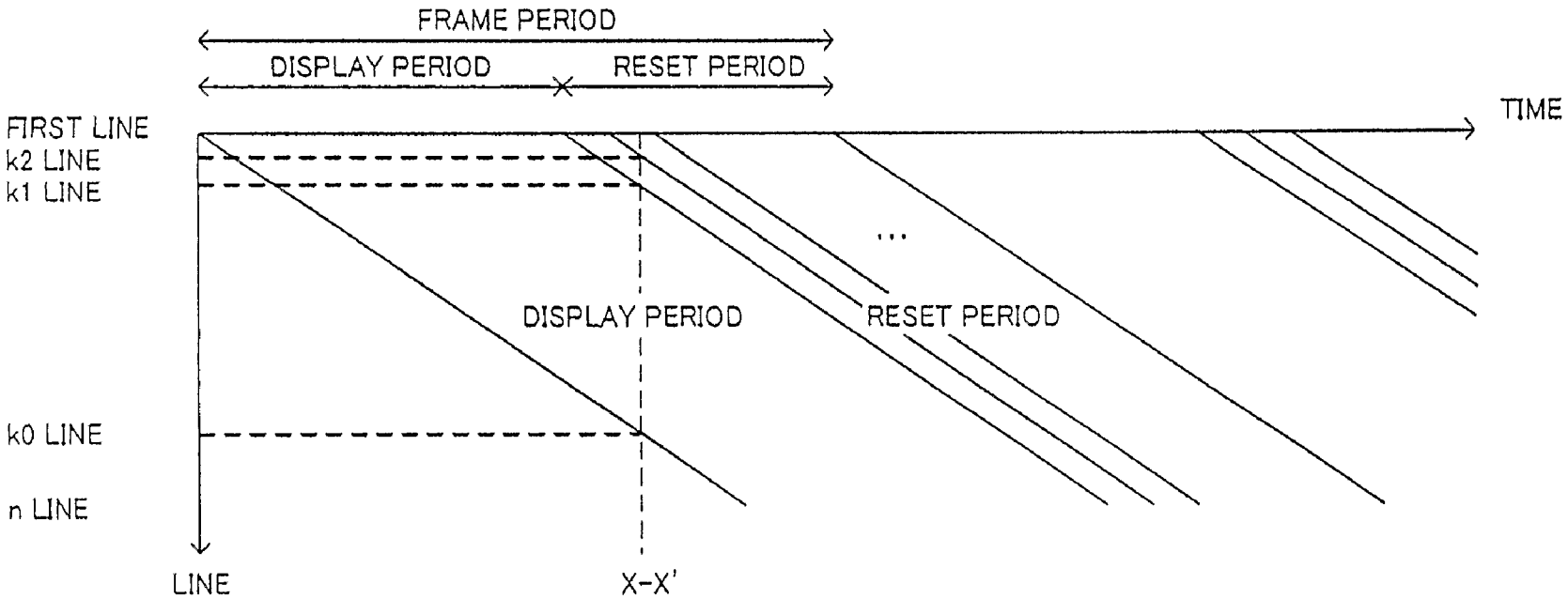
FIG. 5 is a diagram explaining a driving sequence.

FIG. 5 is a diagram showing a display state during a frame period in this embodiment, wherein the abscissa corresponds to time and the ordinates corresponds to a display line. One frame period for each line is divided into a display period during which a video data is displayed and a reset period during which the organic EL element 201 and the driver TFT 202 are reset. It should be noted that "to reset" here refers to an operation to set the gate terminal of the driver TFT 202 at a potential at which no current flows (a pre-charge potential VPRE) so that the organic EL element 201 halts lighting. "A reset period" refers to a period in which that potential is written into the holding capacitor 206 so that the reset state is held until next access for display data is attempted.

A display period is divided as described above because reduction of a display period enables reduction of a writing voltage holding period, and therefore reduction of the influence of a TFT leak current. Moreover, as light emission characteristic similar to that of a CRT can be realized in a pseudo manner, motion picture visibility can be improved.

Initially, video data is sequentially written, beginning with the first line. After a lapse of a certain period and before completion of the video data writing for all lines, the driver TFT 2 having already flowed a current corresponding to the video data is reset in a divided manner at a plurality of times, beginning with those in the first line. In FIG. 5, during the period X-X', the k0 line undergoes video data writing; the k1 line undergoes first resetting; and the k2 line undergoes second resetting.

In the following, a method for conducting display as described above with reference to FIG. 5 by controlling the data driver 102, the gate driver 103, and the pre-charge circuit 104, will be described with reference to FIGS. 6 and 7.

Figure 6:
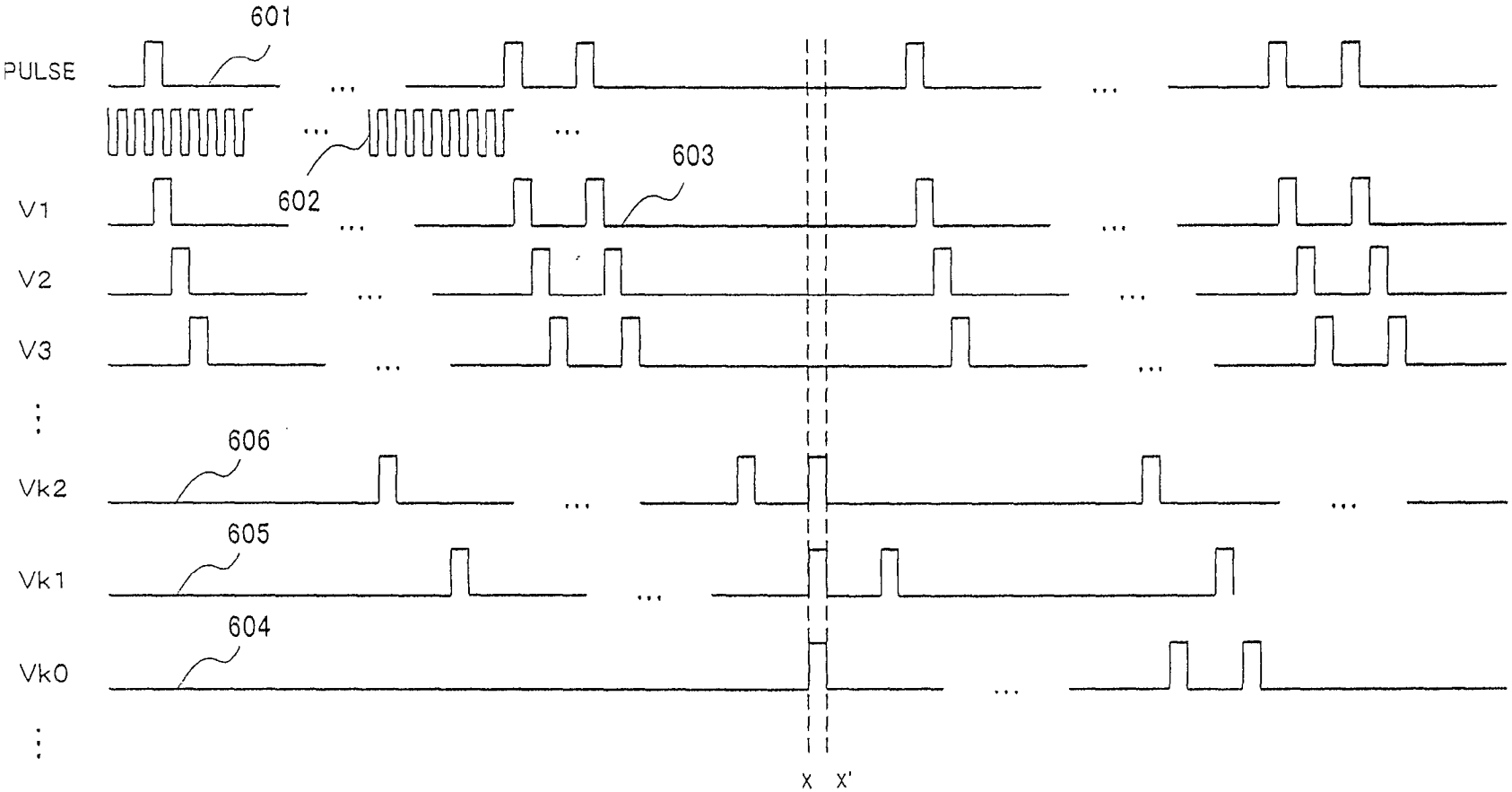
FIG. 6 is a timing chart for panel driving.

FIG. 6 shows an input pulse 601 to be input to the shift register 401 of the gate driver 103, a clock 602 for shifting the input pulse 601, and a shift pulse 603 of the shift register output V1, the shift pulse 603 being sequentially shifted and output from the output Vi. A shift register output pulse 604 for the k0 line, a shift register output pulse 605 for the k1 line, a shift register output pulse 606 for the k2 line are also shown. These pulses remain active during the period X-X'.

Figure 7:
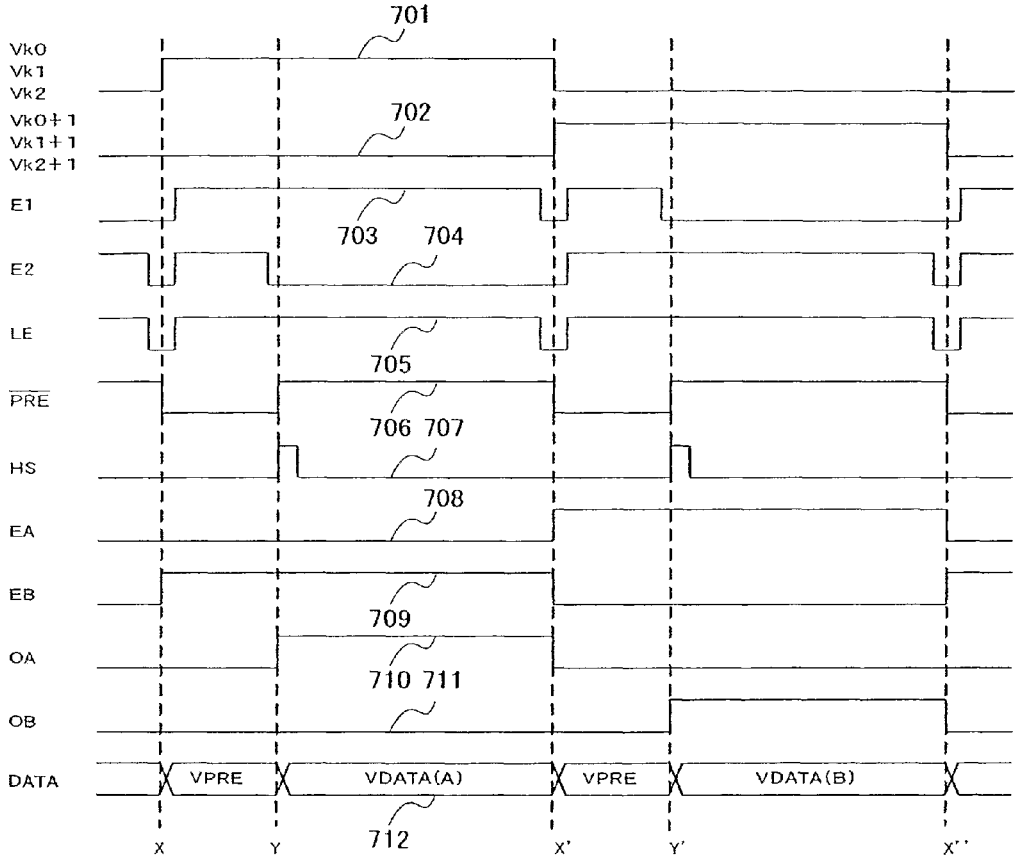
FIG. 7 is an enlarged timing chart for panel driving in the first embodiment.

FIG. 7 shows the respective pulses during the period X-X', the pulses including an output pulse 701 of the shift register outputs Vk0, Vk1, and Vk2, an output pulse 702 of the shift register outputs Vk0+1, Vk1+1, and Vk2+1, a pulse 703 of the enable control line E1, a pulse 704 of the enable control line E2, a pulse 705 of the lighting enable control line LE, a pulse 706 of the pre-charge control line PRE, an input pulse 707 to be input to the shift register of the data driver 102, a pulse 708 of the driver select line for set A, a pulse 709 of the driver select line for set B, a pulse 710 of the output enable OA for set A, a pulse 711 of the output enable OB for set B, and data potential 712 of the data line 107.

When, in FIG. 7, an input pulse 601 is input such that k0 corresponds to an odd number and k1 and k2 correspond to an even number. As the line E1 is at "High", the line LE is at "High", and pre-charge is enabled during the first half of the X-X' period, or the X-Y period, the k0 line is pre-charged. As the line E2 is also at "High", the k1 and k2 lines are also pre-charged.

During this period, while the data line 107 is pre-charged to be at a pre-charge potential VPRE and the gate TFT 205 is turned on, a pre-charge potential VPRE is written into the holding capacitor 206. It should be noted that the pre-charge potential VPRE is at a level at which the driver TFT 202 is turned off, that is, a level close to the potential level of the current supply line 211.

During the second half of the X-X' period, or the Y-X' period, as the line LE is at "High", the line E1 is at "High", the line E2 is "Low", pre-charge is disabled, and the line OA is at "High", only the k0 line undergoes current data writing by the voltage-current conversion circuit of set A of the data driver 102.

As described above, during the period X-X', the k0 line is reset and followed by data writing, while the k1 and k2 lines are only reset.

It should be noted here that the gradation current data to be supplied to the data line 107 is the current data which is output from the voltage-current conversion circuit 304 selected in response to a signal from the output enable OA or OB for selecting the set having incorporated data, after an input pulse 707 input during each horizontal period is sequentially shifted by the shift register 301 and the data in the data bus 311 is incorporated into the voltage-current conversion circuit 304 of a set selected in response to a signal from the select line EA or EB. In short, the current data output to the data line 107 during the period Y-X' corresponds to the data, in this case, having sequentially been incorporated into the set A one horizontal period earlier.

When a gradation current is supplied to the data line 107 during a data writing period within the period Y-X', in the driver TFT 202 in the pixel of the k0 line, as the gate TFT 205 remains in an on state and the lighting control TFT 204 remains in an off state, a gradation current flows from the current supply line 211, through the source and drain of the driver TFT 202, the diode TFT 203, the gate TFT 205, to the data driver.

Because a pre-charge potential VPRE is prewritten to the holding capacitor 206, the gate potential of the driver TFT 202 gradually varies as the gradation current begins flowing to the driver TFT 202, from the pre-charge potential to a potential that can cause the driver TFT 202 to flow the gradation current to the data line 107.

Thereafter, when the lighting control TFT 204 is turned on, a reverse bias is applied to the diode TFT 203 for the above-described reason, as a result of which the path along which the current flows from the data line 107 is blocked. Thereafter, when the gate TFT 205 is turned off, a voltage for causing the driver TFT 202 to flow the gradation current having flowed to the data line 107 is held in the holding capacitor 206.

In the subsequent X'-Y' period, as for the k0 line, while the voltage Vk0 becomes "L", display of the data having written thereto is continued, and a current is kept flowing to the organic EL element 201, using the gradation current supplied thereto, until a next shift pulse is input.

As for the k1 line, the organic EL element 201 halts lighting, and a blackout period thereby begins. Accordingly, after a lapse of a certain period of time, the current flowing to the organic EL element 201 gradually diminishes to zero. As for the k2 line, the organic EL element 201 is already in a blackout period and remains unlit.

Here, it should be noted that the reset operation is applied at a plurality of times, as with the k2 line, in order to ensure reliable reset when a sufficient pre-charge period X-Y and/or X'-Y' period cannot be ensured. Therefore, reset writing may be applied more times.

During the period X'-X", as for the even line k0+1 and the odd lines k1+1 and k2+1, a reset period begins in the first half period thereof, that is, X'-Y', and in the second half period, that is, Y'-X", the k0+1 line alone undertakes current data writing.

Here, it should be noted that the current data then flowing in the data line 107 is the current data obtained from conversion of the voltage data having been sampled by the voltage-current conversion circuit of the set B during the period X-X', that is, the period prior to the period X'-X" by one horizontal period. That is, the current data then flowing in the data line 107 is the result of activating the output enable line OB to thereby drive the data line 107 by the current-voltage conversion circuit.

As described above, the current voltage conversion circuits 304 of sets A and B alternately drive the data line 107. However, the voltage-current conversion circuits of sets A and B could inevitably exhibit a difference in current output characteristic even though the threshold voltage Vth is corrected using the circuit shown in FIG. 15.

In order to address this problem, the manner of set switching is changed for every frame. For example, when, in an odd frame, an odd line is driven using set A and an even line is driven using set B, and in the subsequent even frame, accordingly, an even line is driven using set A and an odd line is driven using set B. With this manner of control, all pixels are driven using set A or B for every frame, and, as a result, the influence of current output variation upon the display state can be reduced. Alternatively, all lines may be driven using the voltage-current conversion circuit 304 of either set A or B alone, that is, one set alone.

As described above, the data driver 102 can transfer, at a high speed, video data from the video signal line 311 to the voltage-current conversion circuit 304. This makes it possible to drive such that data for a single line is transferred to the voltage-current conversion circuit 304 in a pre-charge period X-Y shown in FIG. 7 and an output is enabled to thereby write current data in the remaining period Y-X'. In this manner of driving, provision of two or more sets could suppress yield drop due to circuit and/or driver defect due to non-uniform voltage-current conversion characteristic and so forth, though it results in a redundancy structure.

Naturally, set switching modes are not limited to those described above. For example, in an odd frame, set A may be used to drive, while, in an even frame, set B may be used to drive. Alternatively, not depending on frames, an odd line may be driven using set A, while an even line may be driven using set B. Still alternatively, rather than providing sets A and B relative to each of the RGB signals, sets A and B may be provided relative to only one or two of the RGB signals. For example, sets A and B may be provided relative to a B signal alone, and switched for every frame or line. That is, a plurality of sets may be provided for a particular color when it is desired that variations in characteristics of that color be suppressed.

Alternatively, a plurality of line sets of video signals to be supplied to the voltage-current conversion circuits 304 may be provided in addition to a plurality of sets of voltage-current conversion circuits 304, so that these may be switched as desired. That is, where video signals from a single line set are supplied to either set A or B in the example of FIG. 3, two line sets may be provided for a video signal to provide first video signals (R1, G1, B1) and second video signals (R2, G2, B2). As for these first and second video signals, in response to a signal from the shift register 301, three signals from each of the two video signal line sets (six lines in total) are provided to the voltage-current conversion circuits 304.

With this arrangement, video signals for twice as many pixels can be sampled and held in response to a single pulse from the shift register 301. This enables driving of a panel with higher resolution. The first and second video signals can be switched for every data line. For example, when a certain data line is driven using a first video signal, an adjacent data line for the same color (an adjacent data line for the same color: for an R pixel, the next, adjacent R pixel) is driven using a second video signal.

It is possible to control switching such that the first and second video signals are switched for every frame or to employ line switching, to which the voltage-current conversion circuit 304 applies voltage-current conversion. An example of the switching is described below using an example in which the first and second video signals are switched for every data line, in addition to every frame and line, and that the first and second data lines are adjacent to each other and associated with the same color.

Odd Frame
- an odd line >> first data line: first video signal second data line: second video signal
- an even line >> first data line: second video signal second data line: first video signal Even Frame
- an odd line >> first data line: second video signal second data line: first video signal
- an even line >> first data line: first video signal second data line: second video signal These signals are respectively supplied to the voltage-current conversion circuits 304. Beside this switching control, sets A and B of the voltage-current conversion circuits 304 are also switched for every frame or line. Therefore, combination of these results in the following switching patterns.

Odd Frame
- an odd line >>
  - first data line: first video signal to be driven by set A
  - second data line: second video signal to be driven by set A
- an even line >>
  - first data line: second video signal to be driven by set B
  - second data line: first video signal to be driven by set B Even Frame
- an odd line >>
  - first data line: second video signal to be driven by set B
  - second data line: first video signal to be driven by set B
- an even line >>
  - first data line: first video signal to be driven by set A
  - second data line: second video signal to be driven by set A Many other combinations are possible, including the examples shown below.

Odd Frame
an odd line >>
first data line: second video signal to be driven by set A
second data line: first video signal to be driven by set A
an even line >>
first data line: first video signal to be driven by set B
second data line: second video signal to be driven by set B
Even Frame
an odd line >>
first data line: first video signal to be driven by set B
second data line: second video signal to be driven by set B
an even line >>
first data line: second video signal to be driven by set A
second data line: first video signal to be driven by set A Alternatively,
Odd Frame
an odd line >>
first data line: first video signal to be driven by set A
second data line: second video signal to be driven by set A
an even line >>
first data line: second video signal to be driven by set B
second data line: first video signal to be driven by set B
Even Frame
an odd line >>
first data line: first video signal to be driven by set B
second data line: second video signal to be driven by set B
an even line >>
first data line: second video signal to be driven by set A
second data line: first video signal to be driven by set A Still alternatively,
Odd Frame
an odd line >>
first data line: second video signal to be driven by set A
second data line: first video signal to be driven by set A
an even line >>
first data line: first video signal to be driven by set B
second data line: second video signal to be driven by set B
Even Frame
an odd line >>
first data line: second video signal to be driven by set B
second data line: first video signal to be driven by set B
an even line >>
first data line: first video signal to be driven by set A
second data line: second video signal to be driven by set A Any of the above-noted combinations may be selected for switching control.

As described above, provision of a plurality of line sets of video signals and a plurality of sets of voltage-current conversion circuits 304 enables to accommodate high resolution and obtain driving characteristics with little variation.

Figure 13:
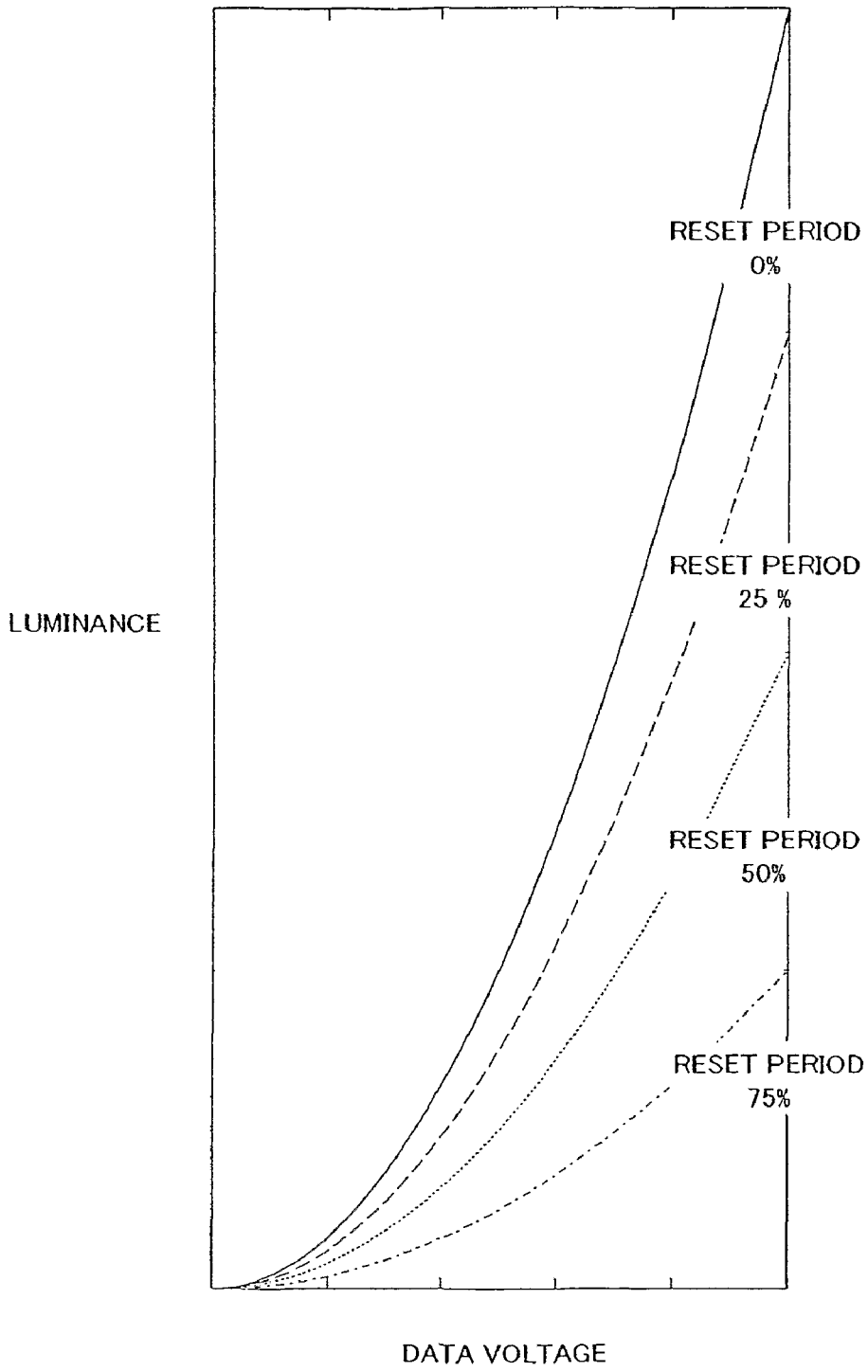
FIG. 13 is a diagram showing correlation between a reset period and gradation characteristic.

In addition, the ratio between display and reset periods can be changed by adjusting an interval between input pulses 601. FIG. 13 shows correlation between luminance and a driver input data voltage Vd in the case of reset periods with durations as long as 25%, 50%, and 75% of the entire frame period.

As a display period becomes shorter when a reset period is made longer, it is possible to control for darker display using the same input data voltage Vd (a current Id corresponding to the data voltage Vd). In order to maintain identical luminance, a larger amount of current is supplied to the driver TFT 202, and for this purpose, the dynamic range of the driver input data may be set larger or conductance of the voltage-current conversion TFT may be increased. Generally, in this current program method, shortage in microcurrent writing is identified. It can be expected that this problem can be solved using the above-described driving method of the present invention.

Specifically, because the data line 107 is pre-charged to be at a pre-charge voltage during the entire time before current programming, the previous data potential does not remain in the data line, and little influence of writing microcurrent shortage appears in the state of display.

Moreover, as the ratio between display and reset periods is variable, when the reset period is set longer to thereby increase a program current, the problem of microcurrent programming can be avoided.

However, it is expected that microcurrent programming will become necessary in the future, even though the above-described means is used, when light emission efficiency of an organic EL element is improved such that only a fewer current value is required to realize desired luminous.

Figure 18A:
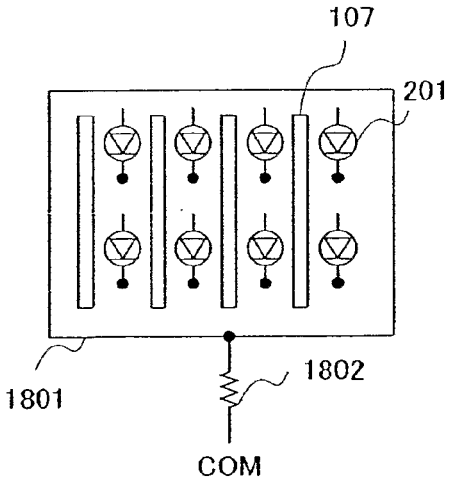
FIG. 18 is a diagram showing a structure of a cathode electrode.
Figure 18:
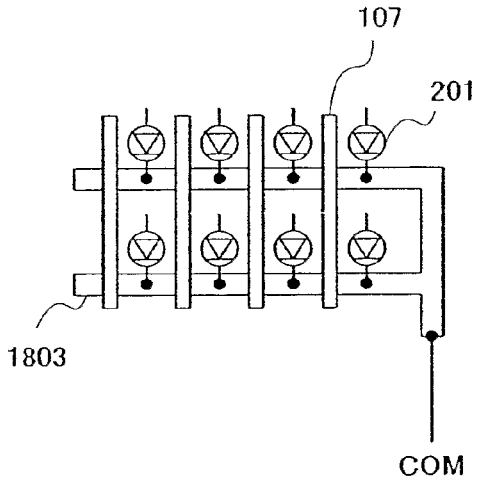

In order to address this problem, a cathode electrode of an organic EL element is formed as shown in FIG. 18(*a*). FIG. 18 shows example structures of a cathode electrode of an organic EL element. FIG. 18(*a*) shows an example of a cathode electrode 1801, while FIG. 18(*b*) shows an example of a cathode electrode 1803.

FIG. 18(*a*) shows a cathode electrode 1801 having a plane structure, in which a current from the organic EL element 20 flows in a two-dimensional manner to a common terminal COM.

The cathode electrode 1803 in FIG. 18(*b*) is different in that a current flows only in a single dimensional manner, that is, in a direction perpendicular to the data line 107, in a region (display region) where organic EL elements 201 are arranged. The data line 107 and the cathode electrodes 1801 and 1803 are formed using different metal layers and insulated from each other via an insulating layer having permittivity $\epsilon$, for example. Therefore, it generally has static capacitance of cross capacitance $C=\epsilon*S/d$, in which S represents a cross area and d represents a thickness of the insulating layer.

A microcurrent from the voltage-current conversion circuit 304 flows to the driver TFT 202 via the data line 107. As the current is micro, the current flowing through a cross capacitance of the cathode electrode and the data line 107, along which the microcurrent flows, is not ignorable, and it is not possible to supply a sufficient current to the driver TFT 202 within a limited horizontal period.

In view of the above, in FIG. 18(*a*), a resistance element 1802 is arranged between the plane cathode electrode 1801 and the external common terminal COM to suppress microcurrent leakage from the data line 107 to the outside so that the microcurrent can flow efficiently to the driver TFT 202. This electrode structure is inexpensive because the cathode can be formed using a mask with low accuracy, similar to a conventional structure.

FIG. 18(*b*) shows an example of a cathode electrode which is formed using a mask with high accuracy. An area where the data line 107 intersects the cathode is smaller in this embodiment. Therefore, as cross capacitance is small, microcurrent leakage through cross capacitance is accordingly small. This makes it possible to efficiently flow the microcurrent from the voltage-current conversion circuit to the driver TFT 202.

A resistance element may be provided between the cathode electrode 1803 and the external common terminal COM also in the structure of FIG. 18(*b*). The structure of FIG. 18(*b*) exhibits higher flow suppression effect with respect to a microcurrent than the structure of FIG. 18(*a*), though it is expensive as it uses a highly accurate mask in formation.

This embodiment includes measures for preventing a reverse bias leak current of a switch TFT and a leak current due to external light.

Specifically, regarding a reverse bias of a gate TFT 205 and an external light leak, little influence of leak current appears on a display state because it is unnecessary, as a result of insertion of a reset period, to hold a certain potential in the holding capacitor 206 during one whole frame. Further, as reset operation is applied at a plurality of times, an insufficient pre-charge potential due to current leakage can be compensated for.

Still further, because the drain and gate terminals of the diode TFT 203 are set at an identical potential when a reverse bias is applied, leak current affects only the source-grate (drain) voltage. This means reduction of a leak current, as compared to a case where a switch TFT having three terminal is used for the diode TFT 203.

As described above, according to the pixel circuit, driver circuit, and driving method of this embodiment, preferable display with less influence of a leak current can be attained.

Second Embodiment

Pixel Circuit

Figure 16:
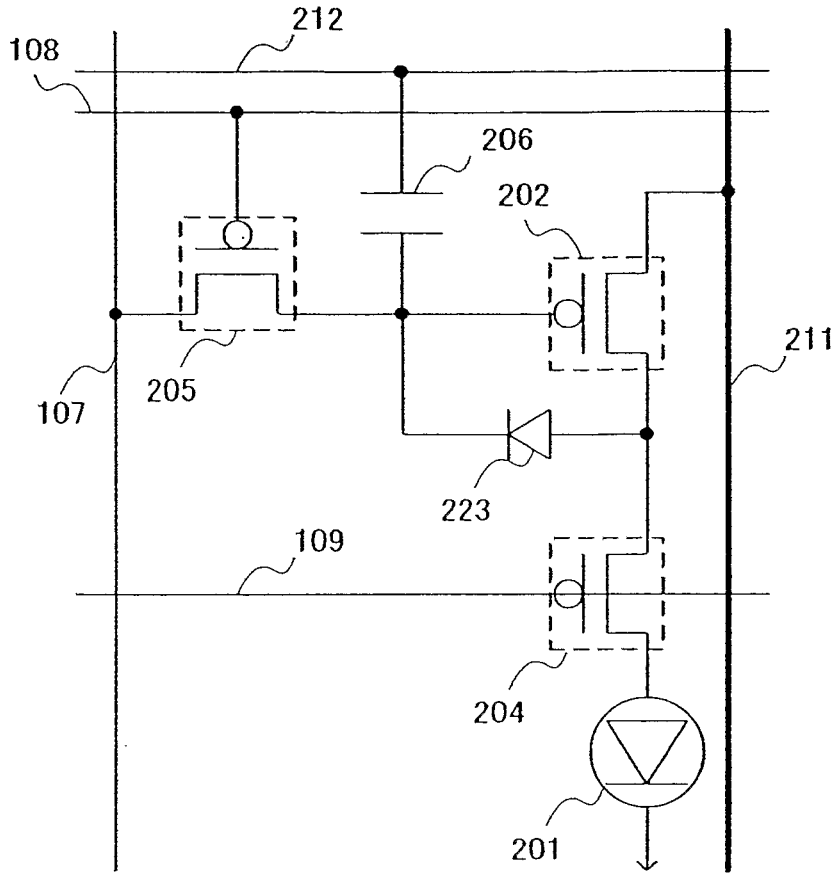
FIG. 16 is a diagram showing a pixel circuit in a second embodiment.

FIG. 16 shows a pixel circuit of a second embodiment of the present invention. The pixel circuit of FIG. 16 is identical to that shown in FIG. 2, with the exception that a diode TFT 223 is used instead of the diode TFT 203 in FIG. 2. The anode of the diode 223 is connected to the drain terminal of the driver TFT 202 and the source terminal of the lighting control TFT 204, and the cathode thereof is connected to the gate terminal of the driver TFT 202, the terminal of the holding capacitor 206 other than the one with a fixed potential, and the source terminal of the gate TFT 205. As the driving method employed in this embodiment is the same as that in the first embodiment, no further description of the method is included here.

Figure 17:
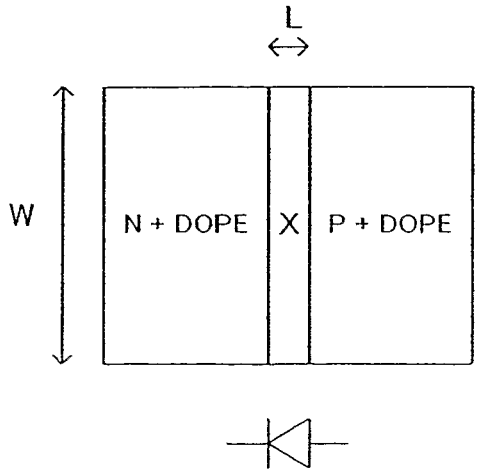
FIG. 17 is a diagram showing a structure of a diode.

FIG. 17 shows an example of a diode 223 formed in typical polysilicon processing. A P+ doped terminal of the polysilicon pattern constitutes the anode of the diode, while an N+ doped terminal thereof constitutes the cathode. The portion X may remain intrinsic (nothing doped) or P− or N− doped. In the drawing, the width W of the diode and the length L of the X region are determined in consideration of the diode characteristics, for example, a leak current, a forward direction voltage, and so forth, when a reverse bias is applied.

Because of the use of the diode of FIG. 17, rather than a diode using a TFT, the pixel circuit of FIG. 16 can reduce the circuit size, and thus increase its aperture ratio, while providing the same functions as those in the first embodiment.

Figure 20:
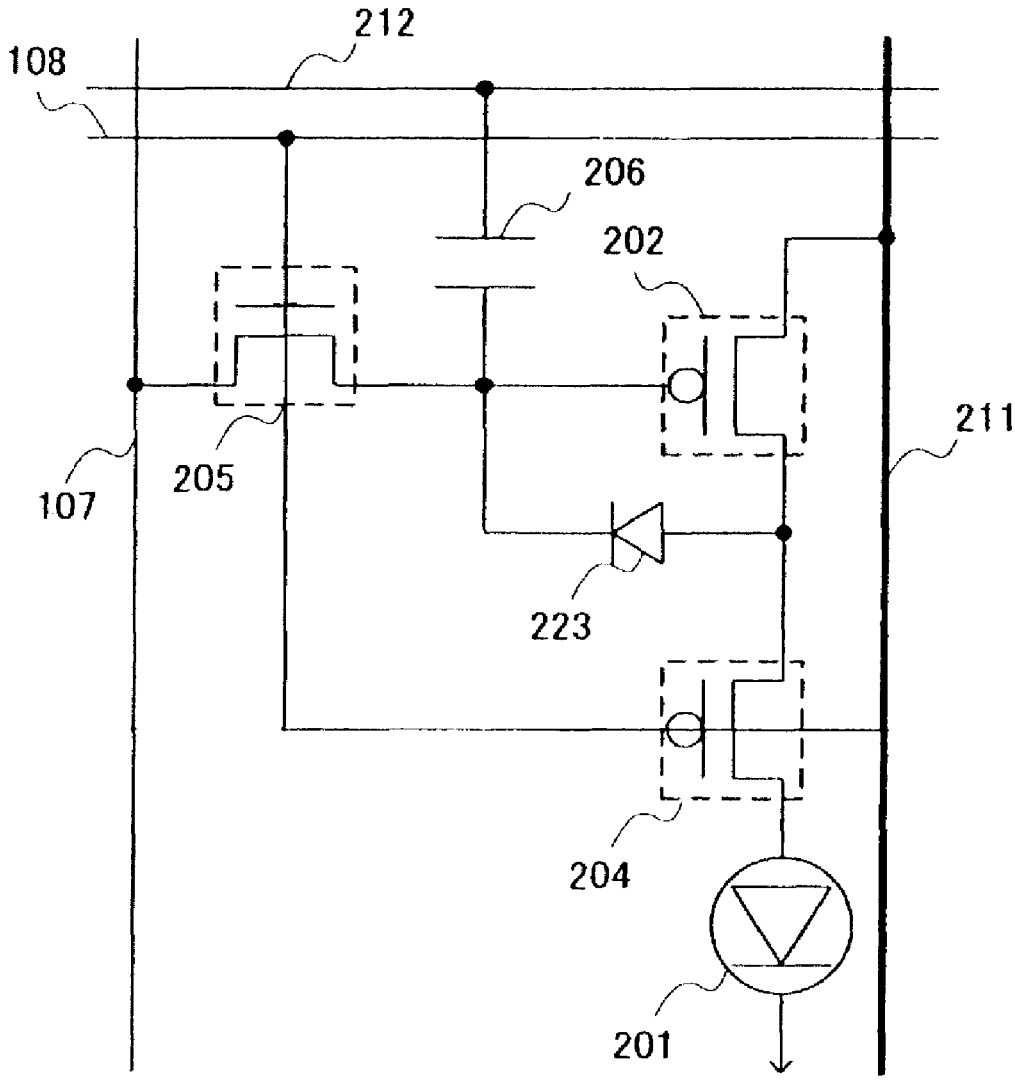
FIG. 20 is a diagram showing a modified example of a TFT pixel circuit in the second embodiment.

FIG. 20 shows an example in which the gate TFT 205 is of an N-type, and has a gate terminal connected to the gate line 108 as well as the gate terminal of the lighting control TFT 204, so that the lighting control line 109 can be omitted. Note that the diode 223 may be substituted by the diode TFT 203. The structure of FIG. 20 can reduce the number of control wires and increase the aperture ratio. Moreover, breakdown frequency of the current can be reduced as a circuit which constitutes the gate driver 103 can be omitted.

Third Embodiment

Pixel Circuit

Figure 19:
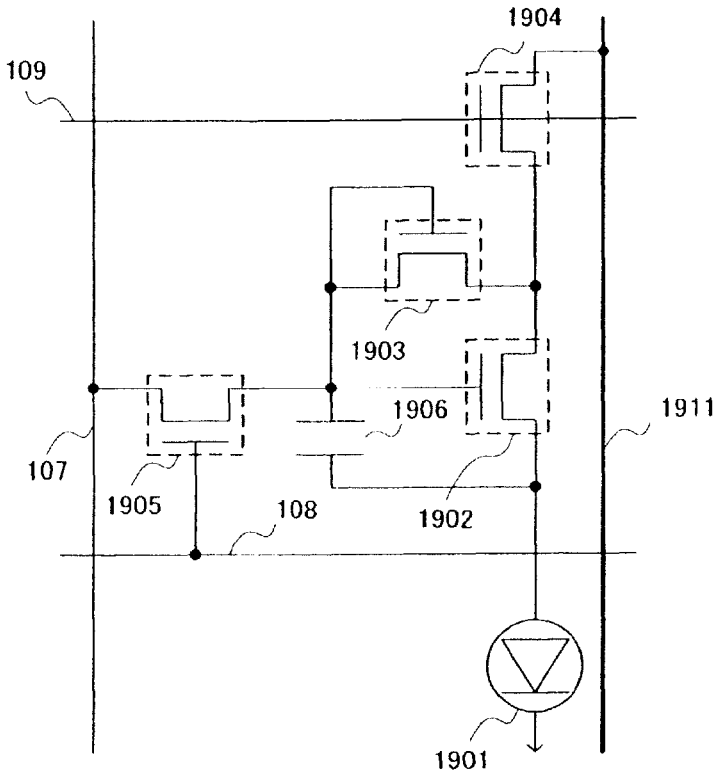
FIG. 19 is a diagram showing a TFT pixel circuit in a third embodiment.
Figure 19:
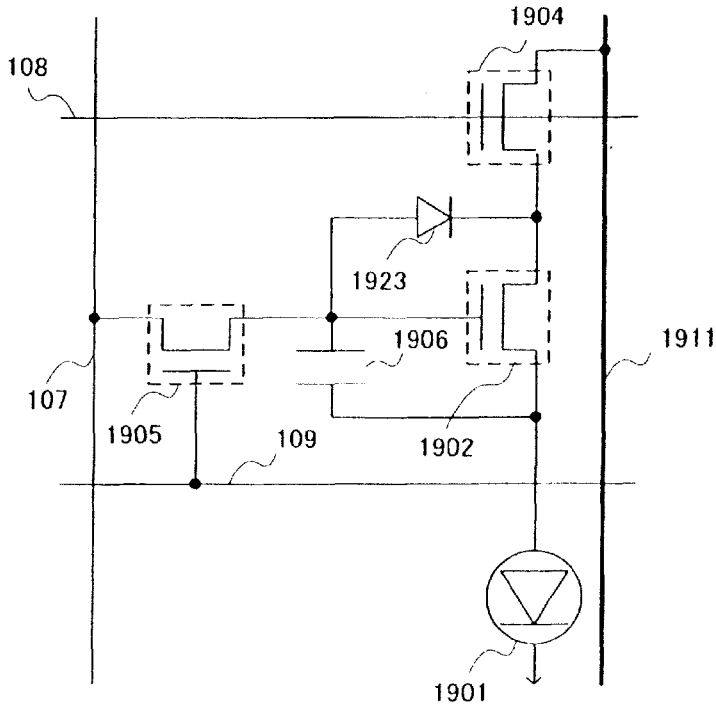

FIG. 19 shows a pixel circuit according to a third embodiment of the present invention. The pixel circuit in FIG. 19 is formed using only an N-type TFT so that the circuit can be formed using an amorphous silicon TFT. Specifically, the pixel circuit of FIG. 19 comprises an organic EL element 1901, a driver TFT 1902, a diode TFT 1903, a lighting control TFT 1904, and a gate TFT 1905, these having the same functions as those of the P-type TFT in the first embodiment.

In simple terms, the source terminal of the gate TFT 1905 is connected to one terminal of the holding capacitor 1906; the drain terminal thereof is connected to the data line 107; and the gate terminal thereof is connected to the gate line 108. The gate terminal of the driver TFT 1902 is connected to one terminal of the holding capacitor 1906 and the source terminal of the gate TFT 1905, and the source terminal thereof is connected to the anode of the organic EL element 1901 and the other terminal of the holding capacitor 1906. A diode TFT 1903 is connected between the gate and drain terminals of the driver TFT 1902. The gate and drain terminals of the diode TFT 1903 are connected to each other (short-circuit). The gate terminal of the lighting control TFT 1904 is connected to the lighting line 109; the source terminal thereof is connected to the drain terminal of the driver TFT 1902; and the drain terminal thereof is connected to the power supply line 1911 to control turning on/off of the organic EL element 1901.

The driving method using the data driver 102, the pre-charge circuit 104, and the gate driver 103 is the same as that in the first embodiment, except for the path along and direction in which current flows. This will be described below.

In the same procedure as that in the first embodiment, at the start of current programming, the organic EL element is reset during the reset period shown in FIG. 5; the lighting control TFT 1904 is in an off state; the gate TFT 1905 is in an on state; and the data line 107 and the gate potential of the driver TFT 1902 are at a pre-charge potential (a voltage level at which the organic EL elements 1901 stops lighting). When the pre-charge of the data line 107 is released and the data driver begins flowing a gradation current, the current flows, through the gate TFT 1905, the diode TFT 1903, and the drain and source terminals of the driver TFT 1902, to the organic EL element 1901. A voltage to cause the driver TFT 1902 to flow the current from the data line 107 is generated between the gate and source of the driver TFT 1902.

Thereafter, when the lighting control TFT 1904 is turned on, a reverse bias is applied to the diode TFT 1903. Thereupon, the current path leading to the driver TFT 1902 is blocked, and a current path leading from the current supply line 1911 becomes effective instead. Thereafter, when the gate TFT 1905 is turned off, the above-noted potential is held in the holding capacitor 1906, and the current keeps flowing to the organic EL element 1901 until access is next attempted.

Substitution of the diode TFT 1903 in FIG. 19(*a*) by a diode 1923 results in the pixel circuit shown in FIG. 19(*b*). The anode of the diode 1923 is connected to the gate terminal of the driver TFT 1902, the terminal of the holding capacitor 1906 other than the one connected to the source terminal of the driver TFT 1902, and the source terminal of the gate TFT 1905. The cathode of the diode 1923 is connected to the drain terminal of the driver TFT 1902 and the source terminal of the lighting control TFT 1904. The driving method and the current path in this circuit are the same as those in the structure of FIG. 19(*a*).

Formation of a pixel circuit using an N-type TFT, as in this embodiment, allows use of not only polysilicon TFT but also less expensive amorphous silicon substrate. This eventually can produce a more inexpensive large-scale organic electroluminescence panel.

Fourth Embodiment

Basic Structure

Figure 9:
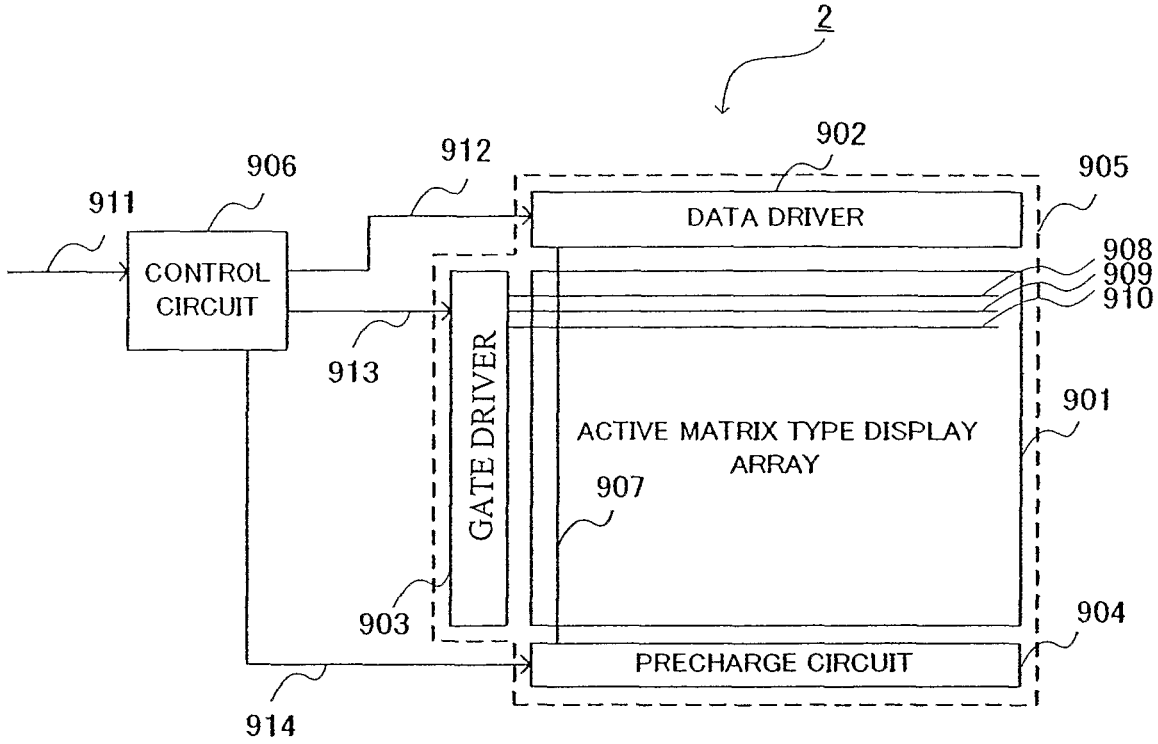
FIG. 9 is a diagram showing a complete structure according to the fourth embodiment.

FIG. 9 shows an entire structure of an organic EL display 2 according to a fourth embodiment of the present invention. Specifically, the organic EL display 2 comprises an active matrix display array 901 having pixels, each having an organic EL element and a TFT, a data driver 902, a gate driver 903, a pre-charge circuit 904, a data line 907 for supplying a gradation voltage from the data driver 902 or pre-charge voltage from the pre-charge circuit 904 to a pixel, a gate line 908 for supplying a gate selection potential from the gate driver 903, a reset line 909 for supplying a reset pulse from the gate driver 903, a lighting line 910 for supplying a control voltage from the gate driver 903 to control lighting of the organic EL element, a control circuit 906 for supplying a video signal and a control signal to the data driver 902 via the data control bus 912, and a control signal via the gate control bus 913 to the gate driver 903, and an input bus 911.

These circuits can be formed on a glass substrate through low temperature polysilicon processing, and can together form a display device 905.

Pixel Circuit

Figure 10:
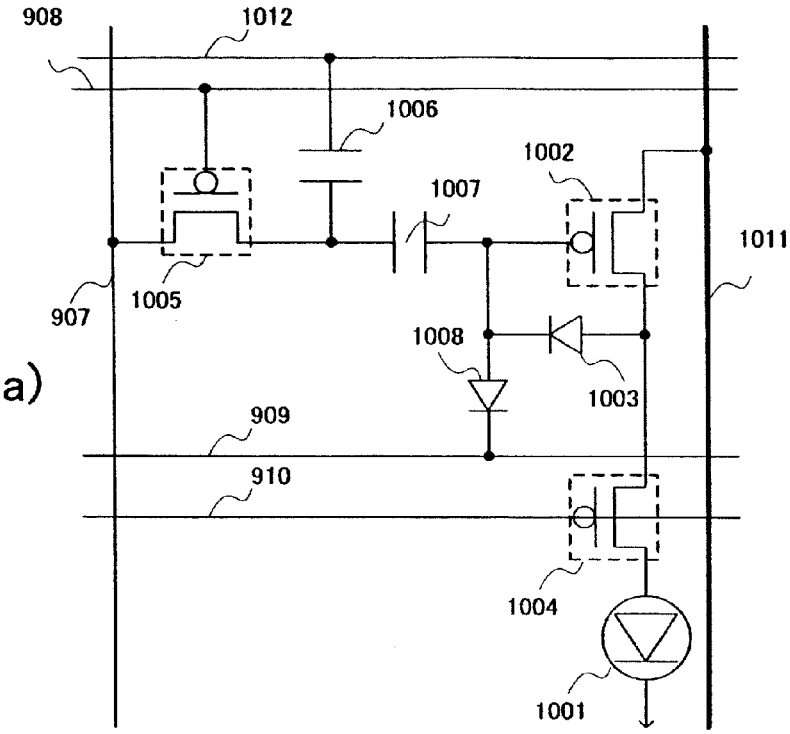
FIG. 10 is a TFT pixel circuit in the fourth embodiment.
Figure 10:
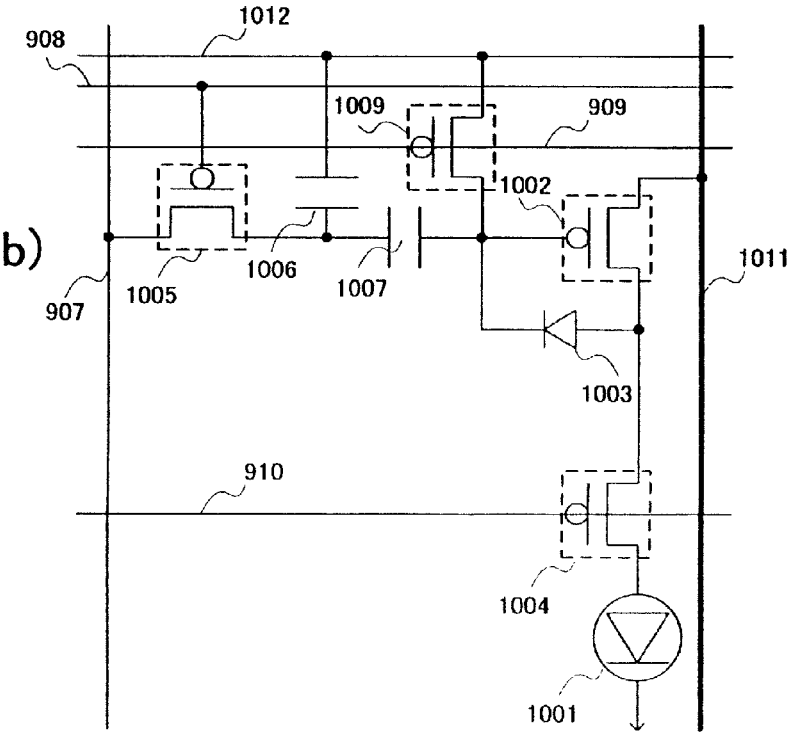

FIG. 10 shows a pixel circuit including a threshold voltage Vth correction circuit, which is placed in an active matrix display array 901. Basically, correction operations of the circuits of FIGS. 10(*a*) and 10(*b*) are substantially the same. The structure of FIG. 10(*a*) comprises an organic EL element 1001, a driver TFT 1002 for controlling a current to be supplied to the organic EL element 1001, a first rest diode 1003 for resetting the driver TFT 1002, a lighting control TFT 1004 for controlling whether or not to supply a current to the organic EL element 1001, a gate TFT 1005 for controlling so as to incorporate a gradation voltage from the data line 907, a holding capacitor 1006 for holding the gradation voltage, a reset capacitor 1007 for writing a threshold voltage Vth of the driver TFT 1002, a second reset diode 1008 for resetting the driver TFT 1002, a current supply line 1011 for supplying a current to the organic EL element 1001, and a fixed potential line 1012 for maintaining one terminal of the holding capacitor at a fixed potential. In FIG. 10(*b*), a reset TFT 1009 substitutes the second reset diode 1008 in FIG. 10(*a*).

Data Driver and Pre-Charge Circuit

Figure 11:
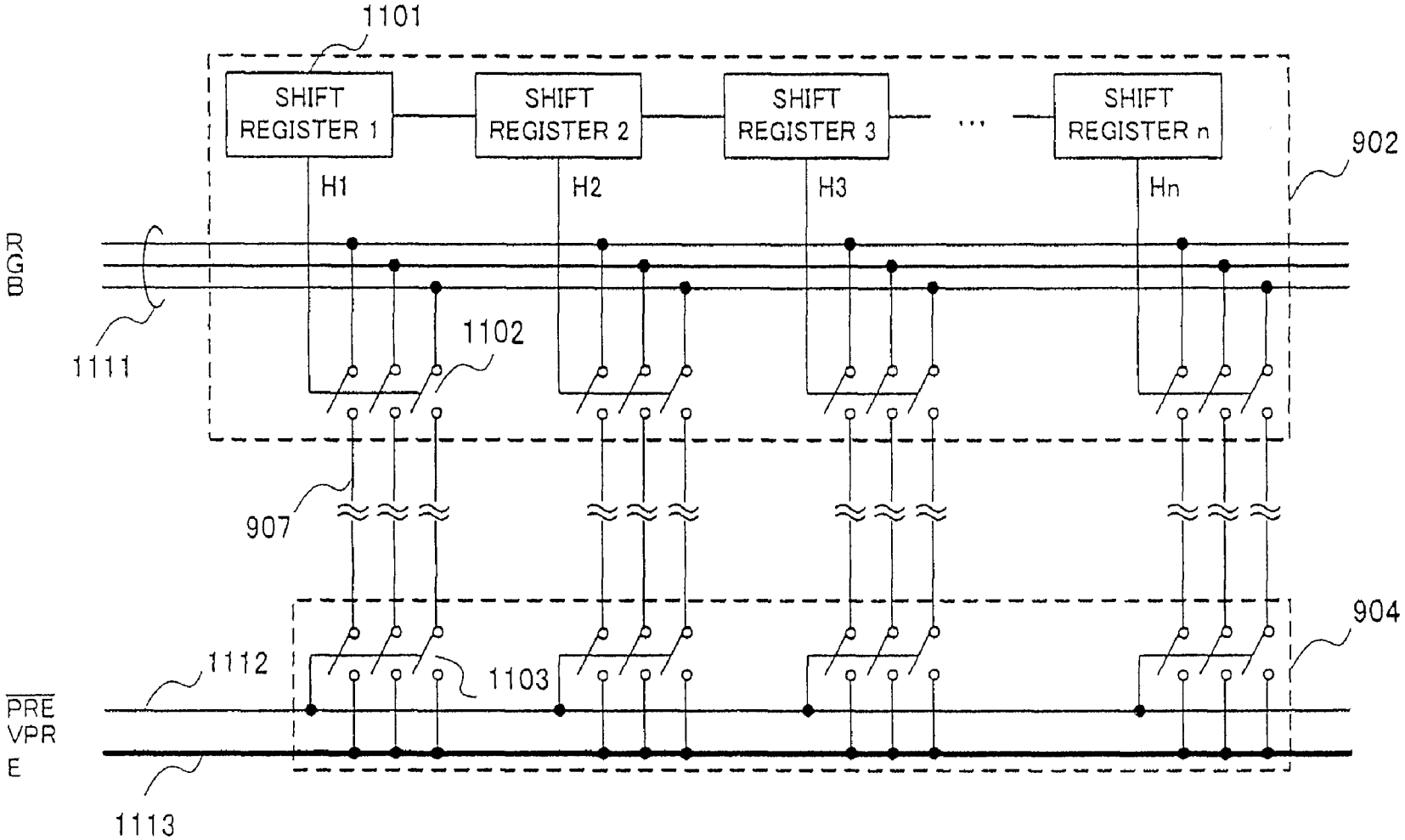
FIG. 11 is a diagram showing an internal structure of a data driver and a pre-charge circuit in the fourth embodiment.
Figure 12:
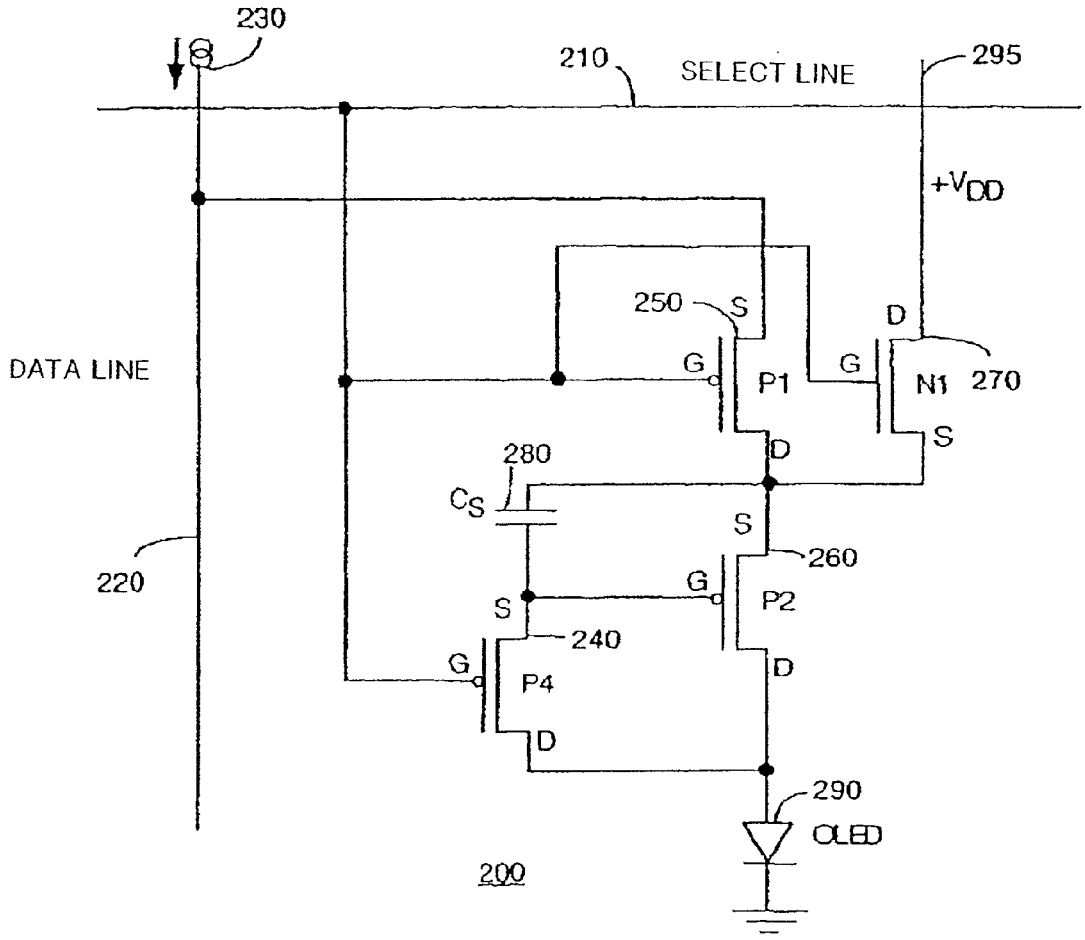
FIG. 12 is a diagram explaining a conventional example.

FIG. 11 shows an internal structure of the data driver 902 and the pre-charge circuit 904 of FIG. 9. The data driver 902 comprises a shift register 1101, a video switch 1102, RGB video signal buses 1111. The pre-charge circuit 904 comprises a pre-charge switch 1103, a pre-charge control line 1112, and a pre-charge potential line 1113.

The shift register 1101 shifts an externally supplied input pulse in response to a clock to sequentially generate pulses, according to which the video switch 1102 incorporates a gradation potential in the video signal bus 1111 into the data line 907.

The pre-charge switch 1103 connects the data line 907 to the pre-charge potential line 1113 in response to a signal for controlling whether or not to pre-charge the pre-charge signal line 1112, to thereby pre-charge the data line 907 to a pre-charge potential VPRE. It should be noted that the data driver 902 may be substituted by a data driver IC having the above-described function or a function pursuant to the function.

Gate Driver

Figure 14:
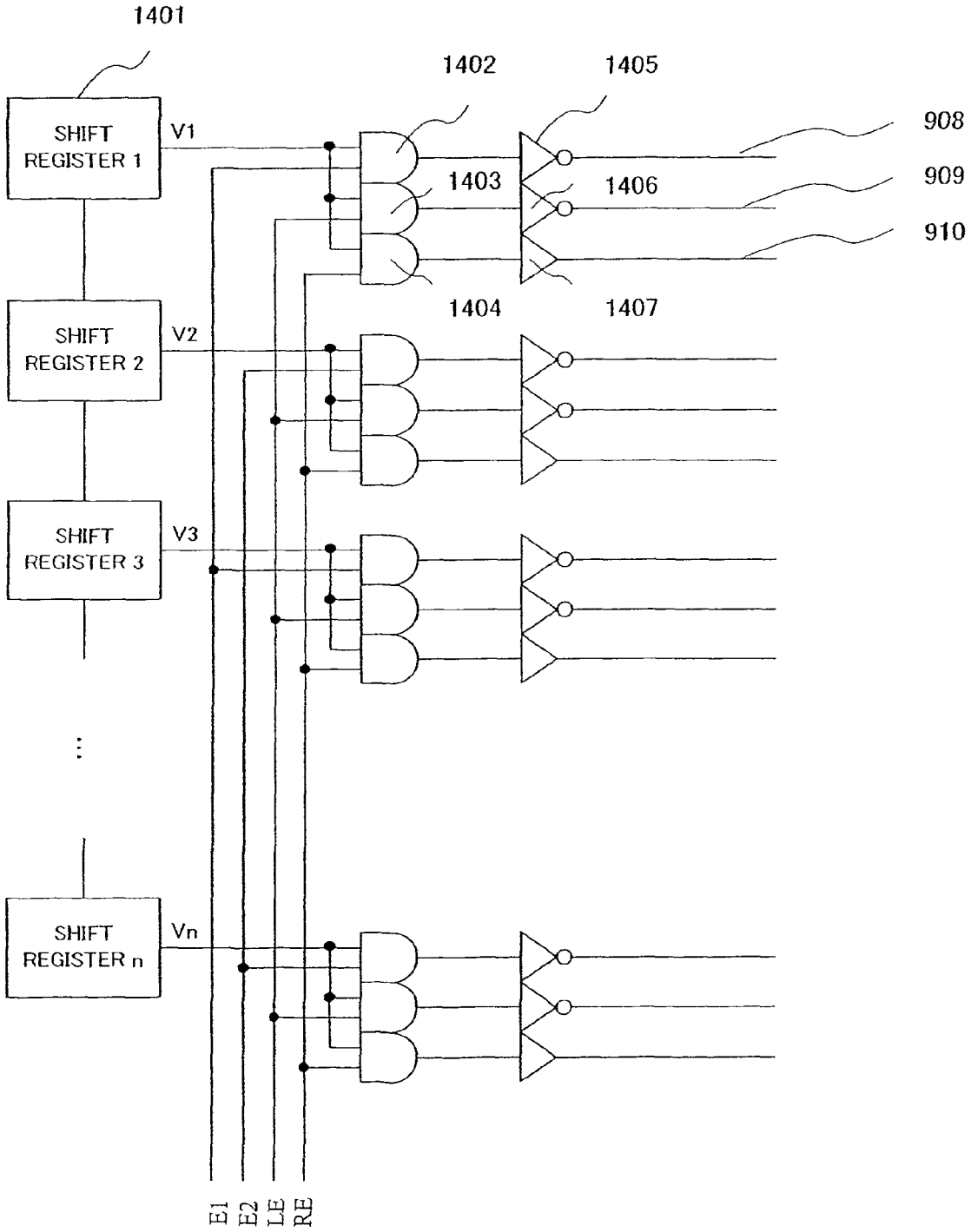
FIG. 14 is a diagram showing an internal structure of a gate driver in the fourth embodiment.

FIG. 14 shows an internal structure of the gate driver 903 of FIG. 9. The gate driver 903 comprises a shift register 1401, a gate enable circuit 1402 for activating the gate line 908, a reset enable circuit 1403 for activating the reset line 909(*a*) lighting enable circuit 1404 for activating the lighting line 910(*a*) gate buffer 1405 for buffering an output from the gate enable circuit 1402, a reset buffer 1406 for buffering an output from the reset enable circuit 1403, and a lighting buffer 1407 for buffering an output from the lighting enable circuit 1404.

One input of the gate enable circuit 1402 of an odd line is connected to the enable control line E1, and one input of the gate enable circuit 1402 of an even line is connected to the enable control line E2. One inputs of the reset enable circuits 1403 of all lines and one inputs of the lighting enable circuits 1404 of all lines are respectively connected to the reset enable control lines RE and the lighting enable control line LE. The other inputs of the gate enable circuit 1402, the reset enable circuit 1403, and the lighting enable circuit 1404 are connected to the output Vi of the shift register of each line.

Driving Method

Figure 8:
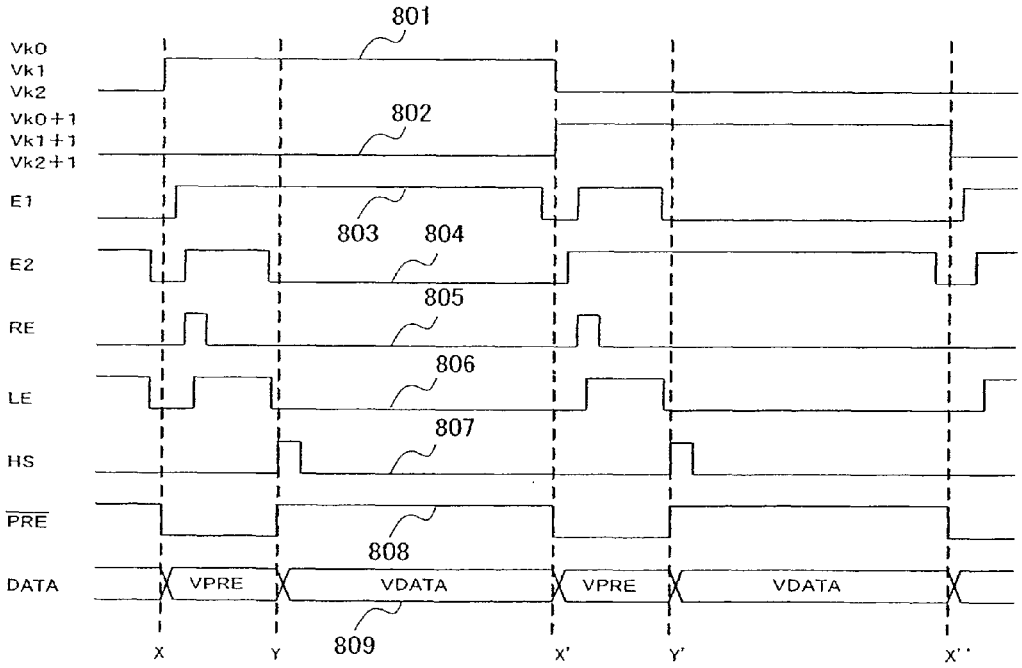
FIG. 8 is an enlarged timing chart for panel driving in a fourth embodiment.

Referring to FIG. 8, an operation of the threshold voltage Vth correction circuit and a method for driving the organic EL element of FIG. 10 will be described.

For lighting control of the organic EL element in this embodiment, one frame period is divided into a display period and a reset period, as shown in FIG. 5. This division is made as reduction of a display period enables reduction of a data voltage holding period, and therefore, influence of a TFT leak current can be reduced. Moreover, it is possible to realize light emission characteristic similar to that of a CRT in a pseudo manner, intending to achieve improved motion picture visibility.

The timing chart for an input pulse to be input to the gate driver 903 and an output Vi (i is a natural number) of the shift register 1401 is the same as that shown in FIG. 6.

FIG. 8 shows an enlarged timing chart concerning a period X-X' in FIG. 6, including a pulse 801 of the shift register outputs Vk0, Vk1, Vk2 for holding a signal for selecting the k0, k1, k2 lines, a pulse 802 for the shift register outputs Vk0+1, Vk1+1, Vk+2, pulses 803, 804 for the enabling signal lines E1 and E2, a pulse 805 for a reset enable control line RE, a pulse 806 for the lighting enable control line LE, an input pulse 807 to be input to the data driver 902, a pulse 808 of the pre-charge control line PRE, and a data potential 809 in the data line.

When an input pulse 601 is input to the gate driver 903 such that k0 corresponds to an odd number and k1 and k2 correspond to an even number. During the period X-Y in FIG. 8, a pre-charge potential VPRE is supplied to the data line 907, and, as the lighting control TFT 1004 is in an off state and the gate TFT 1005 is in an on state in the pixel circuit of FIG. 10, the holding capacitor 1006 is pre-charged with a pre-charge potential VPRE.

According to FIG. 8, there is a period where the reset enable control line RE becomes "High" during this period. That is, as the reset line 909 is made "Low" by the gate buffer 1406, when the "Low" level is such a potential level that turns on the second reset diode 1008 in a forward direction, that is, the "Low" level is sufficiently lower than that of the anode of the second reset diode 1008, in the pixel circuit of FIG. 10(*a*), a current flows from the current supply line 1011, through the source and drain of the driver TFT 1002, the first rest diode 1003, and the second reset diode 1008 during this period.

In the pixel circuit of FIG. 10(*b*), because the reset TFT 1009 is turned on, when the fixed potential line 1012 is at a potential level sufficiently lower than that of the anode of the first rest diode 1003, a current flows from the current supply line 1011, through the source and drain of the driver TFT 1002, the first rest diode 1003, the reset TFT 1009 (a)nd the fixed potential line 1012 during this period.

As the reset enable control line RE soon becomes "Low", that is, the reset line 909(*b*) becomes "High", in the structure of FIG. 10(*a*), when the "High" level is such a potential level that causes a reverse bias to be applied to the second reset diode, that is, higher than that of the anode of the second reset diode 1008, the current having flowed to the driver TFT 102 loses its way, and is converges into a certain potential. The converged potential is a potential at which the current flowed by the driver TFT 102 becomes zero, that is, the threshold voltage Vth of the driver TFT 1002.

In the case shown in FIG. 10(*b*), as the current path is likewise disconnected, the gate potential of the driver TFT 1002 becomes equal to a threshold voltage Vth of the gate potential.

When the lighting control line is set "Low", in other words, when the lighting control TFT 1004 is turned on, at a timing close to the end of the period X-Y, a voltage VPRE-Vth is held in the reset capacitor 1007 because, as the driver TFT 1002 operates in a saturation region, the source and drain voltage Vds of the driver TFT 1002 is large enough to hold |Vds|>|Vgs| relative to its gate and source voltage Vgs, and a reverse bias is applied to the first rest diode. Consequently, the gate-source potential Vgs of the driver TFT 1002 is maintained at the threshold voltage Vth.

In the period Y-X', the enable signal line E2 becomes "Low", after which data writing is conducted only with respect to odd lines. When a gradation voltage Vd is written into the holding capacitor 1006, the gate-source voltage Vgs of the driver TFT 1002 becomes equal to Vd−(VPRE−Vth). An offset of the threshold voltage Vth is always applied, and the threshold voltage Vth of the driver TFT 1002 is corrected.

During the period X'-Y', in which the k0+1, k1+1, k2+1 lines remain in a reset state, by applying a pulse 805 to the reset enable control line RE, a current flows into the driver TFT 1002 along the above-described path for a short period of time, followed by convergence of the gate-source potential Vgs of the driver TFT 1002 into the threshold voltage Vth. Then, the lighting control line 910 is set "High" and the voltage (VPRE−Vth) is written into the reset capacitor 1007.

During the period Y'-X", a data potential Vd of the data line 907 is written into the holding capacitor 1006 of the k0+1 line, and a potential with a corrected threshold voltage Vth is applied to the gate terminal of the driver TFT. The first and second rest diodes may be formed as a P-type MOS diode as shown in FIG. 2, an N-type MOS diode as shown in FIG. 19, or a diode shown in FIG. 17. As the diode shown in FIG. 17 occupies relatively a smaller circuit area, the resultant pixel circuit comprising the threshold voltage Vth correction circuit in this embodiment can advantageously provide a large aperture ratio of the organic EL element.

A threshold voltage Vth correction circuit using the diode element of FIG. 10 can be used as a voltage-current conversion circuit shown in FIG. 15(*b*) within the data driver 102 of the first embodiment of the present invention.

PART LIST

1 organic EL display
101 active matrix display array
102 data driver
103 gate driver
104 pre-charge circuit
106 control circuit
107 data line
108 gate line
109 lighting line
111 input bus
112 control bus
113 control bus
201 organic EL element
202 driver TFT
203 diode TFT
204 light control TFT
205 gate TFT
206 holding capacitor
211 current supply line
212 fixed potential line
220 data line
223 diode TFT
260 TFT
280 holding capacitor
290 organic EL element
301 shift register
302 enable circuit
303 video switch
304 conversion circuit
305 data switch
306 pre-charge switch
311 RGB video signal line
312 driver select lines
313 output enable lines
314 pre-charge enable line
315 potential supply line
401 shift register
402 gate enable circuit
403 lighting enable circuit
404 gate buffer
405 lighting buffer
601 input pulse
602 clock
603 shift pulse
604 output pulse
605 output pulse
606 output pulse
701 output pulse
702 output pulse
703 pulse
704 pulse
705 pulse
706 pulse
707 pulse
708 pulse
709 pulse
710 pulse
711 pulse
712 pulse
801 pulse
802 pulse
803 pulse
804 pulse
805 pulse
806 pulse
807 pulse
901 active matrix display array
902 data driver
903 gate driver
904 pre-charge circuit

905 display device
907 data line
908 gate line
909 reset line
910 lighting line
911 input bus
912 control bus
913 control bus
1001 organic EL element
1002 driver TFT
1003 reset diode
1004 lighting control TFT
1005 gate TFT
1006 holding capacitor
1007 reset capacitor
1008 reset diode
1009 reset TFT
1011 supply line
1012 fixed potential line
1101 shift register
1102 video switch
1103 pre-charge switch
1111 signal buses
1112 control line
1113 potential line
1401 shift register
1402 enable circuit
1403 enable circuit
1404 enable circuit
1405 gate buffer
1406 reset buffer
1407 lighting buffer
1501 conversion TFT
1502 holding capacitor
1503 reset TFT
1504 reset TFT
1505 reset capacitor
1801 cathode electrode
1802 resistance element
1803 cathode electrode
1901 organic EL element
1902 driver TFT
1903 diode TFT
1904 lighting control TFT
1905 gate TFT
1906 holding capacitor
1911 current supply line
1923 diode

The invention claimed is:

1. An active matrix display device, comprising:

a) a plurality of pixels and a plurality of data lines, each pixel connected to one of the data lines for receiving a gradation data current from the corresponding data line and including an EL element for emitting light in response to a drive current, a driver TFT for providing the drive current to the EL element, and a gate TFT for providing the gradation data current to the driver TFT to cause it to provide the drive current;

b) a data driver having:

i) two separate sets of voltage-current conversion circuits for performing voltage-current conversion on an input video signal to supply corresponding gradation data currents; and ii) plurality of output switching circuits, each connected to one of the data lines and to one respective voltage-current conversion circuit in each of the sets for selectively connecting the output from one of the corresponding voltage-current conversion circuits to the data line to supply the corresponding gradation data current to one of the corresponding pixels, with timing being adjusted at least either for each frame or for each line.

2. The device according to claim 1, wherein the video signal is input from a plurality of channels, the device further comprising:

an input switching circuit for switching input of the video signal from the plurality of channels to the voltage-current conversion circuits.

3. The device according to claim 1, wherein:

for an odd-numbered frame, the output switching circuit switches an odd-numbered line of the display array to the first set of voltage-current conversion circuits, and switches an even-numbered line of the display array to the second set of voltage-current conversion circuits; and for an even-numbered frame, the output switching circuit switches an odd-numbered line of the display array to the second set of voltage-current conversion circuits, and switches an even-numbered line of the display array to the first set of voltage-current conversion circuits.

* * * * *